US009732599B1

(12) United States Patent
Dickinson

(10) Patent No.: US 9,732,599 B1
(45) Date of Patent: Aug. 15, 2017

(54) MULTI-TASKING ROD GUIDE HAVING BACKFLOW REDUCER

(71) Applicant: Douglas Ray Dickinson, Houston, TX (US)

(72) Inventor: Douglas Ray Dickinson, Houston, TX (US)

( * ) Notice: Subject to any disclaimer, the term of this patent is extended or adjusted under 35 U.S.C. 154(b) by 181 days.

(21) Appl. No.: 14/636,126

(22) Filed: Mar. 2, 2015

Related U.S. Application Data

(63) Continuation-in-part of application No. 13/437,920, filed on Apr. 2, 2012, now Pat. No. 8,967,247.

(51) Int. Cl.
*E21B 43/12* (2006.01)
*E21B 17/10* (2006.01)

(52) U.S. Cl.
CPC ..... *E21B 43/121* (2013.01); *E21B 17/1071* (2013.01)

(58) Field of Classification Search
None
See application file for complete search history.

(56) References Cited

U.S. PATENT DOCUMENTS 1,801,294 A * 4/1931 Sutton ..... E21B 17/1057 166/241.3
5,507,346 A * 4/1996 Gano ..... E21B 7/061 166/242.1
5,692,562 A 12/1997 Squires
5,740,862 A 4/1998 Sable
5,755,284 A 5/1998 Hart et al.
5,873,157 A 2/1999 Hart et al.
5,941,312 A 8/1999 Vermeeren
6,065,537 A 5/2000 Evans et al.
7,255,165 B2 8/2007 Abdo et al.
7,793,717 B2 9/2010 Davison
7,854,259 B2 12/2010 Davison
2006/0207796 A1* 9/2006 Stewart ..... E21B 10/26 175/57
2012/0186807 A1* 7/2012 Dickinson ..... E21B 43/126 166/241.2

* cited by examiner

*Primary Examiner* — Shane Bomar
(74) *Attorney, Agent, or Firm* — Harrison Law Office, P.C.

(57) ABSTRACT

A multi-tasking downhole rod guide for centralizing a downhole pump rod within a production tubing string, while simultaneously reducing abrasion and deterioration of the production tubing and affording a built-in backflow preventer. The rod guide is configured with an elongate helix having a continuous trough-like channel through which hydrocarbons flow upwardly under high pressure. As the pressurized hydrocarbons flow through a succession of plates at each equidistant helical level, the elongate helix rotates synchronously with the upwardly flowing hydrocarbons within the production tubing string. Integrated bearing assembly and backflow An integrated bearings assembly and backflow restrictor accommodate hydrocarbons flow perturbations and sustain continuous fluid flow uphole.

23 Claims, 17 Drawing Sheets

MULTI-TASKING ROD GUIDE HAVING BACKFLOW REDUCER

RELATED APPLICATIONS

This application is a continuation-in-part of U.S. Non-Provisional application Ser. No. 13/437,920 filed Apr. 2, 2012 which claimed priority based upon U.S. Provisional Application Ser. No. 61/471,196 filed Apr. 3, 2011. The disclosures recited in these related applications are incorporated herein by reference.

FIELD OF THE INVENTION

The present invention relates to a downhole rod guide apparatus, and more particularly relates to an apparatus for performing a rod guide centralizer function downhole within a well bore and also accommodating horizontal drilling and fracking operations, while simultaneously performing tubing-abrasion-reduction and auxiliary pump-boosting functions, and having a built-in backflow reducer to divert impending hydrocarbon backflow.

BACKGROUND OF THE INVENTION

There have been developed several downhole rod guides for sustaining the centralized disposition of a pumping rod within a string of production tubing. It is well known that such conventional rod guides suffer from excessive wear and abrasion under the influence of upwardly streaming high-pressure hydrocarbons. Such hydrocarbon streams typically include abrasive solid materials such as sand and debris which drastically undermine rod guide life cycle particularly because these occluded materials are moving at high speed. In addition, these solids and other troublesome materials appreciated tend to inhibit the upwards hydrocarbon flow.

These and other known deficiencies in the rod guide art have continued to render sustaining continuous flow of hydrocarbons from subsurface formations via downhole pumping systems upwardly to the well surface elusive to remedy, and unduly expensive in view of the necessity to frequently conduct rod guide maintenance because of inherently short life cycles and substantial consumption of energy to sustain demanding pumping requirements. Accordingly, these limitations and disadvantages of the prior art are overcome with the present invention, wherein improved means and techniques are provided which are especially useful for pumping hydrocarbons to the well surface with minimal prerequisite maintenance and without consuming substantial extra energy.

SUMMARY OF THE INVENTION

Embodiments of the present invention afford panoply of functions heretofore unknown in the downhole art. In particular, embodiments not only perform the well-known rod guide centering function relied upon by practitioners in the art, wherein a string of interconnected rotating rods is centrally guided within production tubing, which, in turn, is circumscribed by well casing, but also simultaneously perform a plurality of supplemental functions crucial to efficient continuous lifting of hydrocarbons from a subsurface formation uphole to the well surface.

As will be understood by those skilled in the art, embodiments contemplated hereunder may be adapted to effectively achieve the hydrocarbon pumping purposes prerequisite for many variations of hydrocarbon pumping protocols such as are achieved primarily via circular pumps, and including jack pumps, centrifugal pumps, etc.—with minimal additional energy being consumed. For instance, embodiments hereof may be molded to accommodate a variety of formations and therein be readily adapted to suit both rotating and reciprocating downhole pumping and fracking applications, including horizontal drilling and fracking. As is common in the art, embodiments hereof would be screwably secured, or secured via like connection, to the pump rod at the well base—at the point of downhole hydrocarbon extraction—and with the production tubing locked in situ. Thus, rod guide embodiments of the present invention would be integrated with and disposed concentrically of the axial pump rod in order to perform rod-centralizing in a novel manner heretofore unknown in the art.

Embodiments of the multi-tasking rod guide taught herein preferably comprise an elongate helix, i.e., helical and vertically-elongated configuration, which, as clearly depicted in the drawings, incorporate a spiral configuration preferably nominally every 90°, but not limited to 90°, that continually rotates as hydrocarbons are urged upwardly—from downhole toward the well surface. It will be appreciated that this continual rotational action of upwardly-flowing hydrocarbons causes the helical structure contemplated by embodiments hereof to synchronously rotate along with the flowing hydrocarbons within production tubing and the like. It is estimated that, for every rotation of embodiments hereof, approximately a ½ inch lift is realized per 90°, wherein approximately 2 inches of fluid hydrocarbons are moved and lifted with each rotation.

As will be hereinafter described, preferred embodiments of this instant helical structure are preferably configured to bias upward vertical hydrocarbon fluid movement more than horizontal hydrocarbon fluid movement. It will be understood that angular momentum is engendered and efficiently used to lift recovered hydrocarbons being driven by formidable upward pressure. It will be appreciated that an important aspect of embodiments hereof is that, in the course of achieving unprecedented efficient upward flow of fluid hydrocarbons, there is virtually no inhibiting influence manifest thereupon. Notwithstanding, of course, this paucity of inhibiting influences may be promoted by practitioners in the art invoking such commonly-applied devices as shim-stock or spacers, or otherwise adjusting string-connecting threads to facilitate a tight fit in rod guide embodiments for delivering optimum rotational efficiency contemplated hereunder.

Heretofore unknown in the rod guide prior art, preferred embodiments of the present invention configured with a slip ring or the like at the well surface enable conventional pump-driven rotation to be supplemented by booster pumping action which is effectuated when the "horse" intermittently pulls upwardly and downwardly—manifest as conventional pump action —while causing the pump rod to rotate, thereby causing upwardly-directed pumping action emanating from downhole. It should be evident that that this rotational movement of the helical structure taught herein effectively fosters continuous upward hydrocarbon flow, since crucial downhole pumping function has been unexpectedly and significantly enhanced. Furthermore, it will also be seen that embodiments of the present invention have been preferably structured in order to inherently impart unique dislodging and scooping functions at the well bottom via a specially-configured bottom-level member of the helical structure. More particularly, the downhole hydrocarbon stream is urged to enter a trough member functioning as if it were a track or channel, and then this hydrocarbon stream is pushed upwardly via this channel while being inherently synchronized with rotation of the centralizing rod guide. Accordingly, the fluid hydrocarbon stream is urged upwardly under the forceful influence of preferred embodiments of the instant multi-function rod guide.

It has been found to be advantageous to configure embodiments of the present invention with a top-level member and optionally intermediate-level members—having a plurality of ball bearings or the like, preferably with four or six such ball bearings, in order to facilitate fluid travel and optimal upward hydrocarbon streamline fluid flow mechanics as will hereinafter be described. It will become evident to those skilled in the art that essentially any kind of basic bearings known in the art may be used in embodiments hereof, e.g., roller bearings and cylindrical bearings—sealed or even unsealed. The in situ bearings rotate simultaneously with the instant rod guide and tend to restrict wobbling, elevation changes and other implicated perturbations such as binding which typically cause scoring of interior production tube walls, and accordingly would be adverse to achieving rod or shaft vertical stability and load-bearing capacity, affording concomitant streamline hydrocarbon fluid flow. Thus, those conversant in the art will appreciate that the presence of a plurality of bearings as contemplated hereunder prevents downhole bottom pressures from reaching 30,000 psi or even higher.

For downhole fracking operations that facilitate recovery of entrapped and viscous hydrocarbons, at particular lateral well levels, an alternative embodiment hereof has been found to achieve the advanced rod guide functions herein elucidated. As will be hereinafter described, this embodiment is inherently subject to drag attributable to the rod guide's helix infrastructure and hence is preferably configured with oil ports disposed along the walls for spraying lubricating oil to relieve this drag.

It has further been found to be particularly effective, once hydrocarbon flow achieves typical high-pressures—pressures as high as about 4500 psi—atop the production string, for preferred embodiments hereof to include a spring-loaded retention member or the like to reduce counterproductive reverse flow upon the production string's upwardly-powered flow, manifest when pumping ceases. Preferred embodiments would also be structured with beveled edges or like structures to enable seamless mating with the helical trough member taught herein.

Thus, it will be appreciated that preferred embodiments have been configured to inherently reduce and to minimize, if not avoid, potentially troublesome backflow of hydrocarbons which have been pumped from downhole to the well surface. Since preferred embodiments hereof have essentially minimized the chance of hydrocarbon backflow occurring, conventional procedures such as flow-line re-priming and like precautionary measures known in the art have likely been rendered unnecessary. It will be appreciated by those conversant in the art that invoking preferred embodiments of the instant multi-purpose rod guide have rendered implicated flow-lines devoid of the presence of any air.

Of course, as is well known by those skilled in the art, it is essential that any apparatus introduced into the production string should sustain optimal hydrocarbon flow, i.e., avoid inhibiting upward flow of hydrocarbons. Accordingly, it has been found that helix configurations embodying the present invention should be in the range 90° to 180°, and preferably should be in the range 110° to 130°, and more preferably should be in the range 115° to 120°.

It will also be seen that embodiments of the present invention should preferably overlap the production string inner wall at the top portion of the well. To achieve this inner wall-overlap, a suitable predetermined portion of the inner wall should be cut or carved out for snugly and securely accommodating therewithin the implicated portion of the instant multi-tasking rod guide. As an example, for producing wells having 4 inch inside diameter production tubing, ¼ inch thick, a 5 inch top piece would be appropriate. The walls could be situated as 4½ inches with ¼ inch indenture achieved by cutting ⅛ inch into each side, to effectuate the prerequisite contemplated overlap. For this illustration having a 4 inch length from the offset and a ¼ inch cut into the inner surface of the wall, the extra pump-boosting pressure urging upward hydrocarbon flow may be shown by the formula:

$$\text{Volume for rotation}=(\pi)\times(4\tfrac{1}{4}\text{ inch})\times(2\text{ inches}) \quad (1)$$

Practitioners in the art will recognize this relationship as corresponding to the volume of hydrocarbon liquid being lifted upon and through the helix structure of the present invention. If rotation of the production string were to cease, then it is contemplated that the helix configuration taught hereunder would be sealed because of plugging that would inherently be consequently effectuated, thereby reducing undesirable, troublesome backflow.

Thus, it should be evident that important features of embodiments hereof are manifest as the elongate helical structure revolves each cycle through its heighth, thereby sustaining the centered position of the production rod, while simultaneously performing in-line booster pumping upon the upwardly-flowing stream of hydrocarbons. Such in-line booster pumping, in turn, urges implicated hydrocarbon flow upwardly through the trough channel path of the continuously rotating instant helix structure.

It will also be seen that preferred embodiments of the present invention should be designed with a plurality of sharp edge members at the bottom of the helix in order to break up accumulations or clumps of high-viscosity tar balls and the like, akin to the action of a conventional paper-cutter. By avoiding or at least minimizing the adverse impact of high viscosity clumps of tar balls and the like, embodiments hereof tend to optimize the upward flow of hydrocarbons as contemplated hereunder.

It is accordingly an object of the present invention to provide a novel downhole rod guide that exceeds the capabilities and expectations of rod guides known in the art.

It is also an object and advantage of the present invention that a multi-tasking rod guide is disclosed that not only handily performs the centering function known in the art, but also affords auxiliary pumping to supplement upwardly pumping of hydrocarbons from the well-bottom and inherently imparts less abrasion on the contact surfaces of production string and casing walls, respectively.

It is another object of the present invention that a multi-tasking rod guide is disclosed that inherently imparts less abrasion on the contact surfaces of production string and casing walls, respectively, than has been heretofore experienced in the art.

It is another object and advantage of the present invention that a multi-tasking rod guide is disclosed that not only handily performs the centering function known in the art, but also affords auxiliary pumping to supplement lateral fracking and associated upwardly pumping of hydrocarbons from the well-bottom and inherently imparts less abrasion on the contact surfaces of production string and casing walls, respectively.

It is also an object and advantage of the present invention that embodiments inherently afford a backflow reducer function profoundly essential for assuring safe production from subsurface hydrocarbon reservoirs and, in so doing, virtually eliminating occurrence of catastrophic oil spills that inflict substantial harm to workers, animals, fish, and the environment.

It is also an object of the present invention that embodiments simultaneously perform a plurality of functions without substantially increasing the demand for consumption of energy.

These and other objects of the present invention will become apparent from the following specifications and accompanying drawings.

DETAILED DESCRIPTION

Figure 1:
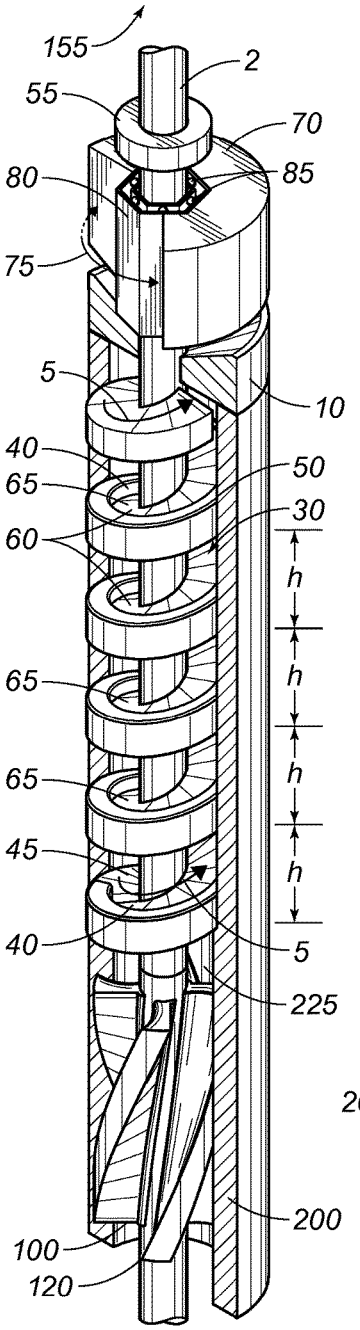
FIG. 1 depicts a frontal perspective view of a multi-tasking rod guide embodiment of the present invention, with half of the well casing removed.

Reference is made herein to the figures in the accompanying drawings in which like numerals refer to like components. These like numerals are preceded by "II" or "III" to correspond to each of the two specially-configured bearings embodiments of the present invention described herein. More particularly, in view of several of these components being integrated into each of the advanced rod guide embodiments depicted in FIGS. 1-9, in FIGS. 10-16 and in FIGS. 17-25, like components are preceded by a "II" to identify the components incorporated into the second embodiment illustrated in FIGS. 10-16 and by a "III" to identify the components incorporated into the third embodiment illustrated in FIGS. 17-25.

Referring to FIGS. 1-9, there is depicted a preferred embodiment of the present invention corresponding to a multi-tasking rod guide apparatus 10 circumscribing and centralizing pump rod 2 as will be hereinafter described. Specifically referring now to FIGS. 1 and 2, there is depicted a frontal perspective view of the elongate continuous helical configuration 30 taught by the present invention and a corresponding frontal cross-sectional view thereof, respectively. In particular, the helix comprising helical portion 30 is elongated in a vertical orientation and comprises a continuous trough-like channel 40 disposed on each plate member 65 situated on each of a succession of helical levels of plurality of plate members 60. As depicted therein, each level of plurality of levels 60 comprises plate member 65. Thus, fluid hydrocarbons 5 are driven upwards via continuous trough or channel 40 and its implicated plurality of collection plates level members 60, and is ultimately delivered to well surface 155 under high-pressure.

As clearly shown in partial cut-away frontal view in FIG. 1, while helical member 30 comprises a plurality of levels 60 with each level 65 being virtually identical to the other, top-level collection plate member 70 and bottom level scooping plate member 100 are configured differently in order to afford specific functions as herein described. In particular, the angular disposition of plurality of plate members 60 and top-level collection plate member 70 are offset from 90° for enabling uninterrupted upward hydrocarbon flow through continuous channel 40. Bottom-level plate member 100 is configured at a steeper angle adjacent the well bottom in order to enable snow-shovel-like combined dislodging and scooping actions to facilitate, first, urging separation of viscous hydrocarbons 5, e.g., as tar balls and the like, from the well bottom and, second, urging entry of such dislodged and scooped viscous hydrocarbons into channel lowest level 45 and consequent upward travel thereof along the trough-like channel 40 manifest on each plate member 65 situated on each corresponding successive helical level member of plurality of level members 60, as hydrocarbon 5 is driven to the well surface 155 under high-pressure. Rod 2 is circumscribed by plurality of components, in turn, solid metal flange ring including plurality of oil ports disposed therearound; bearing plate with threaded flange and interspersed oil ports and preferably diamond bearings or the like; bearing ring having interspersed oil ports and preferably diamond bearings or the like; cast metal ring with troughs cut for accommodating bearing rings circumscribed by bearing ring trough; another set of ring having interspersed oil ports and preferably diamond bearings or the like; bearing plate with threaded flange; solid metal flange ring; and preferably 90° plurality of blade members.

Moreover, it will be appreciated that, in such environments of extreme viscosity, embodiments of the present invention may optionally include any of several well-known heating protocols to overcome pumping limitations. For instance, in one embodiment of the present invention, an electric heating member may be incorporated thereinto in order to further augment its extraordinary inherent pumping capability. That is, based upon the novel helical structure taught herein, embodiments hereof may be invoked to supplement conventional pumping action and normal pump capabilities by tending to boost upward hydrocarbons fluid flow through its helical trough-like structure. It will be readily appreciated that this supplemental pumping aspect of the present invention continuously urges upward channel-flow of hydrocarbons until the top-level collection plate member has been reached and, ultimately, until the well surface has been reached shortly thereafter. It will also be understood that other environmental pumping limitations may be attributable to variation in temperature of downhole hydrocarbons so that a plethora of alternating hot spots and cold spots may be overcome by providing heat thereto, particularly at and/or near the well-bottom.

It will be understood that embodiments hereof have been structured to afford sufficient vertical support attributable to its inherent stability. Referring again collectively to FIGS. 1-9, each pillar member 68 of the plurality of pillar members is disposed between each successive level member 65 of plurality of level members 60 to afford strength to the helical structure contemplated herein. Another aspect of this innate stability is the plate structure which includes the herein described backflow reducer. According to the present invention, this unique backflow reducer may be emplaced at a plurality of locations throughout the production string in order to achieve sufficient stability and simultaneously to avoid or minimize the adverse effects of wobbling or other deviations from pure rotation prerequisite to efficient upwards flow of hydrocarbons through production tubing. It should be evident that the bearing-based apparatus taught herein should be judiciously applied throughout the production string, as deemed appropriate, to assure maximal hydrocarbon production with minimal probability of losing control of such production wherein spills and the like can cause catastrophic loss of life and damage to property and the environment.

More particularly, the opening 75 of this backflow reducer 80 is preferably 90° to 120° which corresponds to about ¼ of 360°. Preferably constructed from solid metal or like strong and solid material, the backflow reducer acts like an immovable weight when it is caused to essentially drop into a 90° to 120° "hole" 75 if and when rotation abruptly ceases.

Ergo, it will be readily seen that backflow reducer 80 plugs the implicated 90°-120° hole 75, thereby preventing undesirable hydrocarbon backflow. It should be appreciated that the presence of a plurality of ball bearings on plurality of rollers 85 enable backflow reducer 80 to readily adapt as hydrocarbon fluid conditions vary, by appropriately sliding upwardly and downwardly to sustain optimal flow of hydrocarbon to the well surface. To further assure stable operation of embodiments of the present invention, a plurality of structural detent members 55 is disposed above the backflow reducer 80 to limit and control the extent of its upward movement. Embodiments of the backflow reducer may be configured with 8 sides instead of 6 sides especially to accommodate asynchronous rotation, thereby tending to effectively prevent hydrocarbon backflow under a diversity of demanding conditions.

Figure 2:
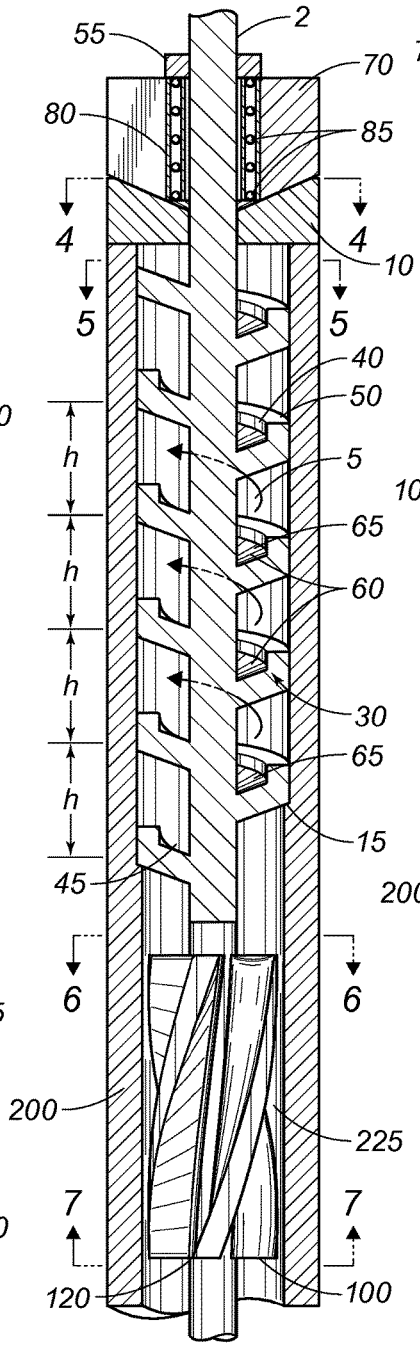
FIG. 2 depicts a cross-sectional view of the multi-tasking rod guide embodiment depicted in FIG. 1, and depicting a side view of the lower section thereof.
Figure 3:
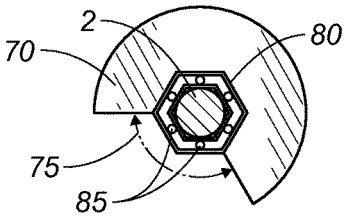
FIG. 3 depicts a top view of the backflow reducer feature of the multi-tasking rod guide embodiment of the present invention depicted in FIGS. 1 and 2.
Figure 4:
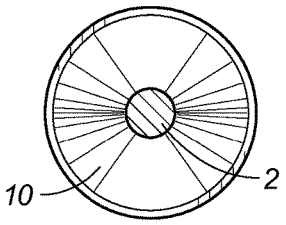
FIG. 4 depicts a top view of the multi-tasking rod guide embodiment depicted in FIG. 1.
Figure 5:
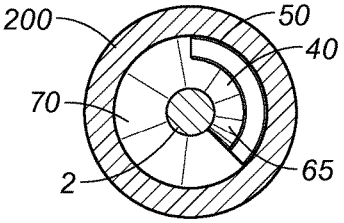
FIG. 5 depicts a cross-sectional view of the multi-tasking rod guide embodiment depicted in FIG. 2, wherein the section is depicted along line 4-4.
Figure 6:
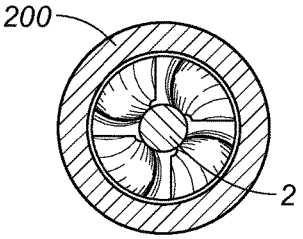
FIG. 6 depicts a cross-sectional view of the multi-tasking rod guide embodiment depicted in FIG. 2, wherein the section is depicted along line 5-5.
Figure 7:
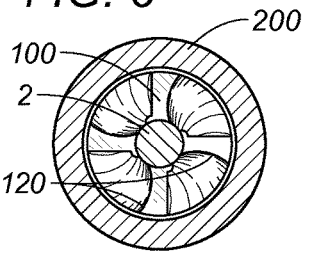
FIG. 7 depicts a bottom view of the multi-tasking rod guide embodiment depicted in FIGS. 1 and 2.

In order to enable this contemplated efficient scooping function, it has been found that offsets ranging from about 20° to 30° are preferred; it will be understood by practitioners skilled in the art that these preferred offsets correspond to angles of about 110° to 120° relative to the horizontal. Those conversant in the art will also note that the elongated helix located at the lower plate level of plurality of plates 60 is depicted in FIG. 2 with a bevel 50 disposed on the rear of the helix. This bevel configuration tends to avoid striking the production tubing 200 in a flat disposition, thereby affording extra support thereto, and smoothly commencing continuous upward helical movement thereof as contemplated hereunder.

Each successive level member 65 of this helical configuration should preferably be successively spaced apart equidistant in a vertical disposition with height "h" between each such level member being essentially identical to every other level-member height differential. For instance, in one application of instant multi-tasking rod guide 10, each helix level member 65 has been designed to measure approximately h=2½ inches. With each level of helix 65 configured to be angled upwards, there is formed a trough-like channel 40 that tends to guide the pressure-driven continuous flow of hydrocarbon fluid 5 upwardly as the helix of the helical portion 30 is caused to rotate synchronously with hydrocarbon 5 within concentrically situated interior wall 225 of production tubing 200. Hydrocarbon fluid 5 ultimately reaches atop axial pumping rod 2 near well surface 155 and tends to be delivered via a squirting and spraying action thereof atop at helix level member 70, which serves as a collection plate or the like.

Thus, as clearly depicted in the partial cut-away views in each of FIGS. 1 and 2, top collection plate 70 contained at the upper level member of helix 30 is configured to be thicker than plurality of lower level members 60 of this helix structure. For the illustrative scenario hereinbefore referenced, having a preferred thickness of from about 1½ to 2 inches, top plate member 70 lends integrity atop production string 200 as high-pressure hydrocarbon stream 5 is thrust upon this uppermost plate member typically with a squirting action.

Now referring to FIGS. 1-3, 6, and 8, the backflow attenuation aspect hereof is depicted. As will be appreciated by practitioners skilled in the art, backflow reducer 80 enables hydrocarbons 5 to continuously flow upwardly within production string 200 without being inhibited by contra-flowing hydrocarbons. In this preferred embodiment, reverse flow reducer 80 is structured in a hexagonal configuration with a plurality of rollers 85 or the like affixed on at least two of its sides in order to promote uninhibited rotational movement thereof and raising or lowering thereof as hydrocarbon flow conditions may dictate.

It is also an aspect of the present invention that the fit of backflow reducer 80 should preferably be essentially flush with interior walls 225 of production tubing 200 or include bevels 50 to assure that there is inherently no backflow so long as power is being supplied to the downhole pump system. Thus, where hydrocarbons 5 enter top helix plate 70 by a squirting and spraying action thereonto, this backflow reducer 80 should preferably fit snugly so as to securely seal hydrocarbon fluid 5 collected upon top-level member 70.

Based upon conditions prevalent in the downhole art, those skilled in the art will appreciate that it should generally be advantageous to provide the helical structure of the present invention with sides of ¾ to 1 inch width in order to achieve contemplated structural stability prerequisite for minimizing or even eliminating lateral movement thereof. In addition, it will also be understood that the clearance range of embodiments of the present invention are relatively small because of the extremely high pressures manifest during contemplated pumping of hydrocarbon towards the well surface. Indeed, based upon observations and experience in the art, a clearance as small as 0.01 inch may be too large and thus may be inadequate to be compatible with the protocol herein described.

Accordingly, preferred embodiments of the present invention should have a clearance range of only 0.155 to 0.005 inch to effectively perform as herein described. That is, affording a tight fit between the exterior of rod guide embodiments of the present invention and production tubing interior surfaces is crucial to the successful heretofore unrealized efficient upward flow of hydrocarbon fluid. In conjunction with the stable structures taught hereunder, such close tolerances prevent lateral shimmy effects or slipping of rod guide 10 annularly disposed between pump rod 2 and production tubing 200, thereby wholly avoiding consequent damage to production tubing attributable to scoring by grit and like foreign solid matter situated in situ with hydrocarbon 5 streaming upwardly to the well surface at high speeds and under high pressures.

Based upon conditions prevalent in the downhole art, it is generally advantageous to provide the helical structure of the present invention with sides of ¾ to 1 inch width in order to achieve contemplated structural stability for minimizing or even eliminating lateral movement. It will also be readily appreciated by practitioners familiar with adverse viscosity conditions in Venezuela and similar exigent environments, wherein tar and likewise viscous materials are unavoidably present, that, as depicted in FIGS. 1 and 2, bottom-level member 100 comprises plurality of specially-configured members 120 having sharp rib-like and blade-like members for inherently simultaneously cutting into and dislodging viscous, semi-solid and liquid hydrocarbons, thereby promoting upward flow thereof—under the influence of downhole pumping known in the art—but reinforced by the auxiliary pumping action taught by the present invention.

Moreover, it will be appreciated that, in such environments of extreme viscosity, embodiments of the present invention may optionally include any of several well-known heating protocols to overcome pumping limitations. For instance, in one embodiment of the present invention, an electric heating member may be incorporated thereinto in order to further augment its extraordinary pumping capability. That is, based upon the novel helical structure taught herein, embodiments thereof may be invoked to supplement conventional pumping action and normal pump capabilities by tending to boost upward hydrocarbons fluid flow through its helical trough-like structure. It will be readily appreciated that this supplemental pumping aspect of the present invention continuously urges upward channel-flow of hydrocarbon until the top-level collection plate member has been reached and, ultimately, until the well surface has been reached shortly thereafter. It will also be understood that other environmental pumping limitations may be attributable to variation in temperature of downhole hydrocarbon so that a plethora of alternating hot spots and cold spots may be overcome by providing heat thereto, particularly at and/or near the well-bottom.

It will be understood that embodiments hereof have been structured to afford sufficient vertical support attributable to its inherent stability. Referring now to FIGS. 1-2, and 8-9, each pillar member 68 of the plurality of pillar members 66 is disposed between each successive level member 65 of the plurality of level members 60 to afford strength to the helical structure contemplated herein.

Another aspect of this innate stability is the top-level plate structure which includes the hereinbefore described backflow reducer. More particularly, the opening 75 of this backflow reducer 80 is preferably 90° to 120° which corresponds to about ¼ of 360°. Preferably constructed from solid metal or like strong and solid material, the backflow reducer acts like an immovable weight when it is caused to essentially drop into a 90° to 120° "hole" 75 if and when rotation abruptly ceases.

As has been explained herein, backflow reducer embodiments essentially function by closing or plugging an implicated 90°-120° hole or gap, thereby limiting disadvantageous hydrocarbons backflow. It should be appreciated that the presence of a plurality of bearing members 85 enable this novel backflow reduction feature readily adapt as hydrocarbons fluid conditions vary, by appropriately sliding upwardly and downwardly to sustain optimal flow of hydrocarbons to the well surface. To further assure stable operation of embodiments of the present invention, a plurality of structural detent members 55 is disposed above backflow reducer 80 to limit and control the extent of its upward movement. Embodiments of the instant backflow reducer may be configured with 8 sides instead of 6 sides especially to accommodate asynchronous rotation, thereby tending to effectively attenuate hydrocarbons backflow under a diversity of demanding conditions.

Those skilled in the art will appreciate that the present invention seals off the high-pressures that are engendered downhole and that drive hydrocarbons to the well surface, and, in so doing, inherently restricts direct pressure from being imposed upon vertical side wall by deflecting direct pressure thereupon. There is no bleed-over manifest on the sides thereof, shielding the sides from astronomically high pressures from the surface.

Referring now to FIGS. 10-16, there is depicted an embodiment of the present invention II-10 incorporating a bearings assembly 300 conducive to accommodating lateral flow of viscous and semi-liquid hydrocarbons released from being captured within downhole hydrocarbons formations at a particular level of a well via hydraulic fracturing or the like. It will be appreciated by those skilled in the art that such a multi-tasking rod guide apparatus II-10 circumscribing and centralizing pump rod II-2 should preferably afford multi-functions, including cutting edges to shred the clumped and viscous tar-like hydrocarbons, and a bearings assembly to readily move up and down to accommodate flow perturbations by urging streamline flow uphole at designated well levels. Such real-time adapting to adverse hydrocarbons flow inhibitions and the like, common in fracking circumstances, enables bearings embodiments hereof to achieve the upward continuous flow of hydrocarbons contemplated herein.

Figure 10A:
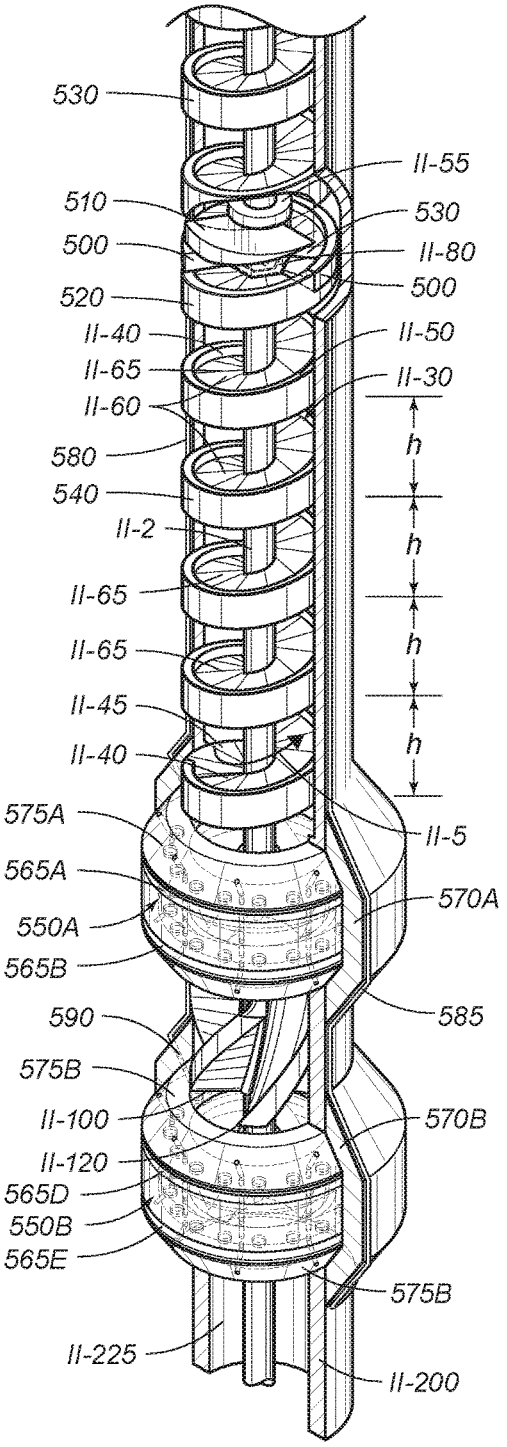
FIG. 10A depicts a cut-away frontal perspective view of another multi-tasking rod guide embodiment with half of the well casing removed and having an integrated double bearing member and an integrated backflow reducer disposed in an open position.
Figure 10B:
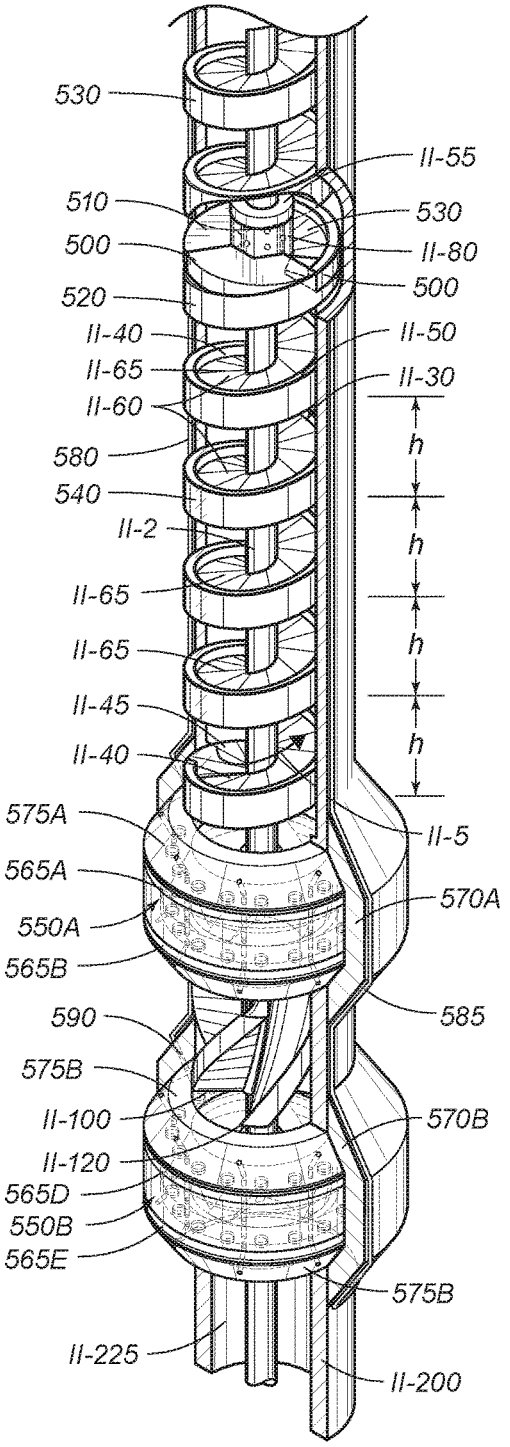
FIG. 10B depicts another cut-away frontal perspective view of the multi-tasking rod guide embodiment depicted in FIG. 10A, but having its integrated backflow reducer disposed in a closed position.
Figure 11A:
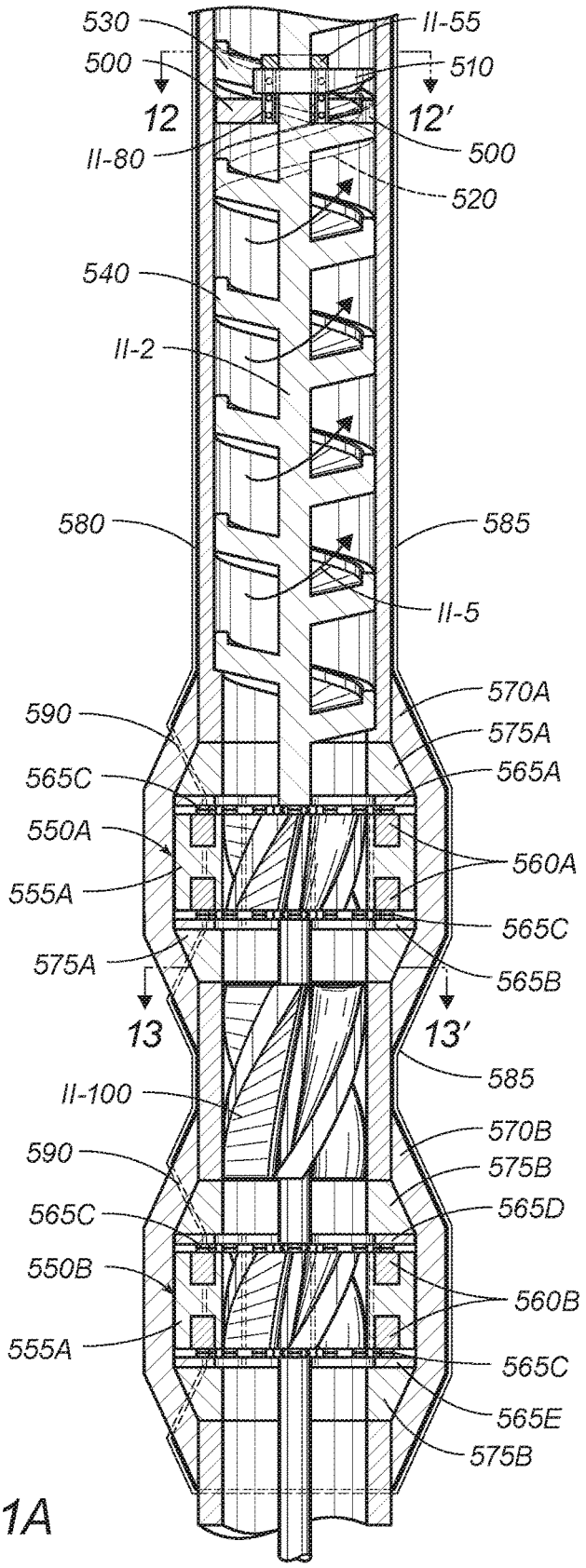
FIG. 11A depicts a cross-sectional view of the multi-tasking rod guide embodiment depicted in FIG. 10A, and depicting a side view of the lower section thereof.
Figure 11B:
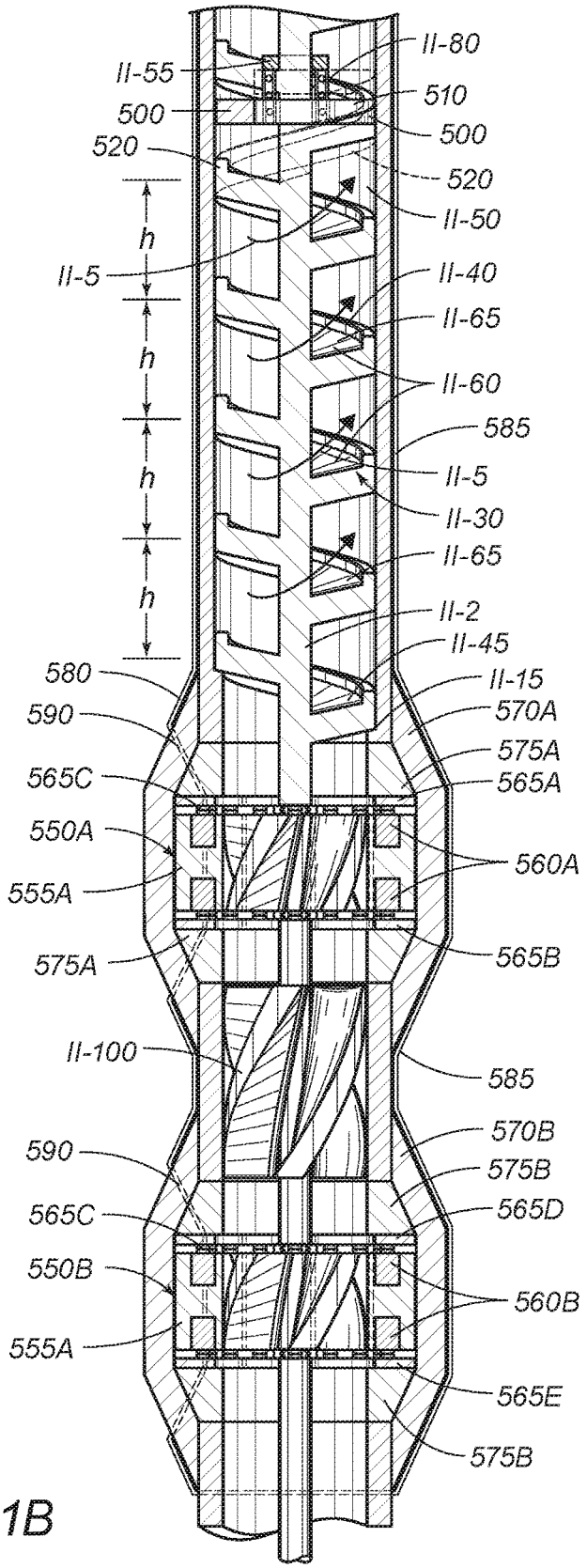
FIG. 11B depicts a cross-sectional view of the multi-tasking rod guide embodiment depicted in FIG. 10B, and depicting a side view of the lower section thereof.
Figure 11C:
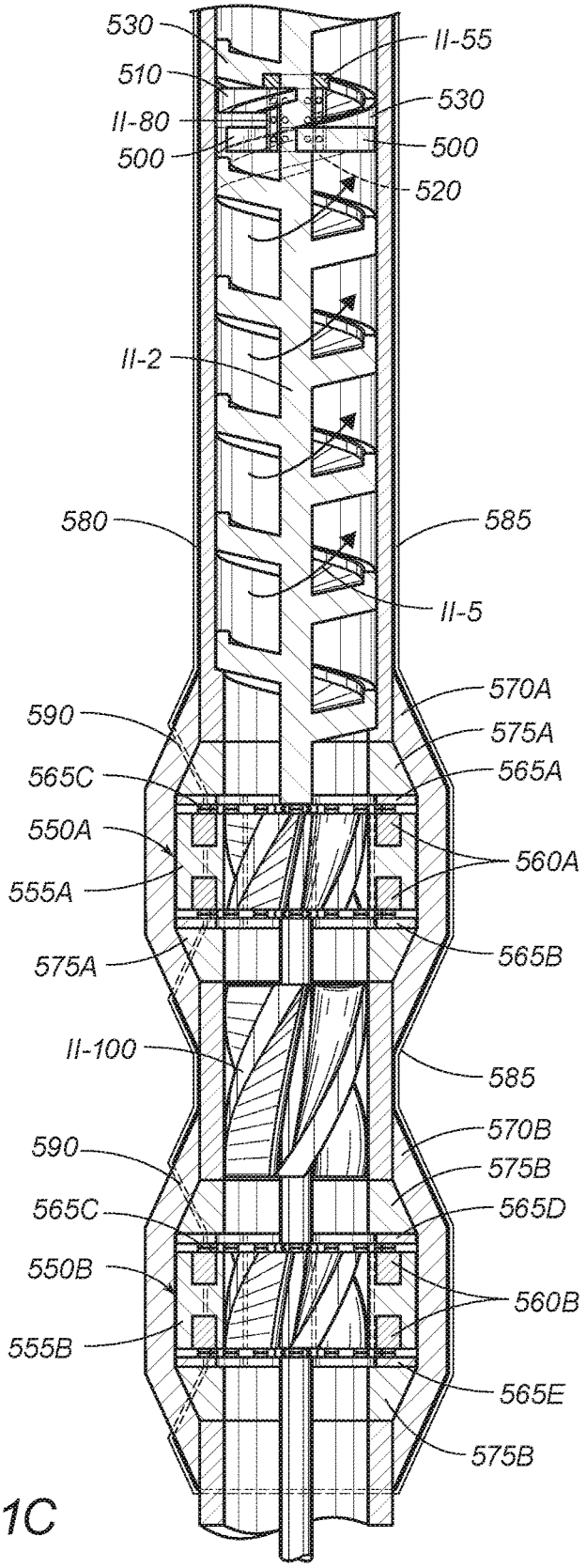
FIG. 11C depicts the respective cross-sectional and side views of the multi-tasking rod guide embodiment depicted in FIG. 11B rotated 90° counterclockwise.

Specifically referring now to FIGS. 10A and 10B there are depicted frontal perspective views of the elongate continuous helical configuration II-30 taught by the present invention and, in FIGS. 11A and 11B, there are depicted corresponding frontal cross-sectional views thereof, respectively. In particular, the helix comprising helical portion II-30 is elongated in a vertical orientation and comprises a continuous trough-like channel II-40 disposed on each plate member II-65 situated on each of a succession of helical levels of plurality of plate members II-60. As depicted therein, each level of plurality of levels II-60 comprises plate member II-65. Thus, fluid hydrocarbon II-5 is driven upwards via continuous trough or channel II-40 and its implicated plurality of collection plates level members II-60, and is ultimately delivered to well surface 155 under high-pressure.

As clearly shown in partial cut-away frontal views in FIGS. 10A and 10B, while helical member II-30 comprises a plurality of levels II-60 with each level II-65 preferably being virtually identical to the other. Upper-level collection plate member comprising stationary portion 500 configured to encompass 240° and to mate with sliding portion 510 configured to encompass 120°, thus, when plate members 500 and 510 are mated, 360° is encompassed. As will become clear to those skilled in the art, as depicted in FIG. 10B, when corresponding plate member portions 500 and 510 are mated, i.e., disposed in a closed position, the backflow reduction feature of the present invention is invoked wherein hydrocarbons fluid flow ceases. On the contrary, as depicted in FIG. 10A, when corresponding plate member portions 500 and 510 are not mated or conjoined, i.e., disposed in an open position, the backflow reduction feature of the present invention is not invoked wherein hydrocarbon fluids flow continuously, i.e., without interruption.

Figure 10C:
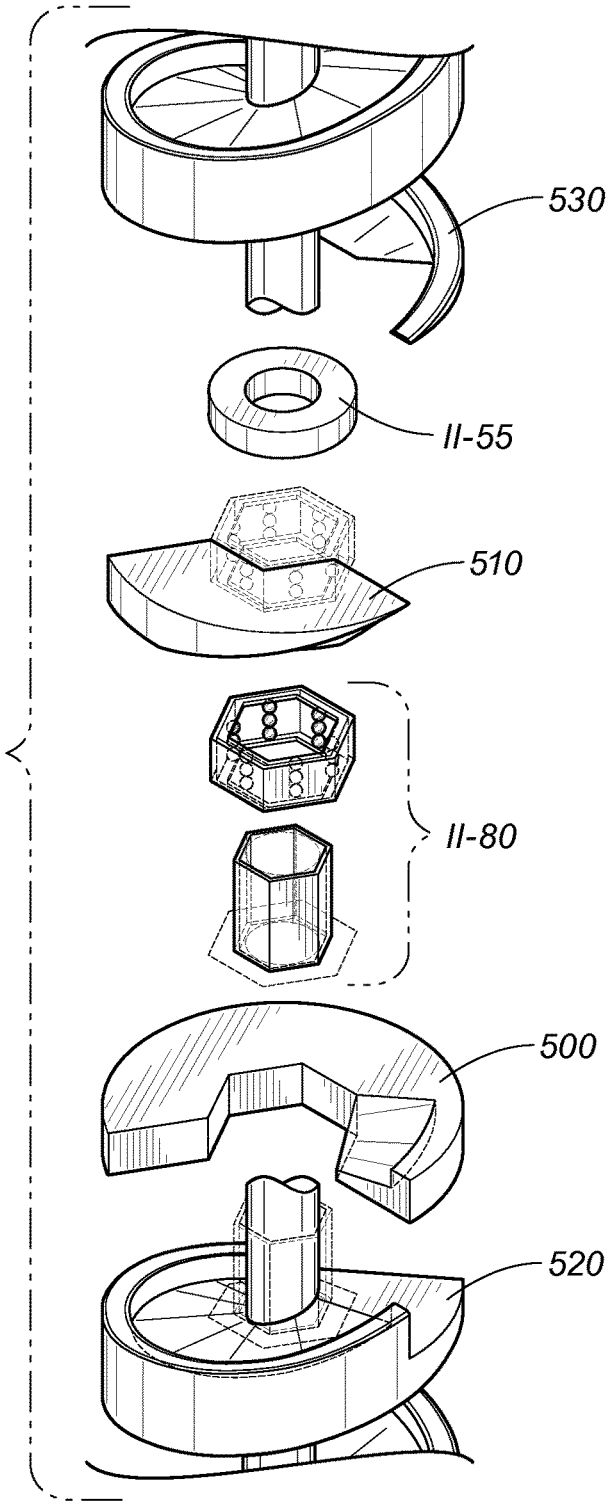
FIG. 10C depicts a frontal perspective exploded view of the backflow reducer of the embodiment depicted in FIGS. 10A and 10B, focusing on the portion thereof that opens and closes to control hydrocarbons flow.

The exploded frontal perspective view depicted in FIG. 10C illustrates the relationship between stationary plate member 500 and sliding plate member 510. Also depicted is the functional relationship between trough 520 and associated with plate member 500, and between trough 530 and associated with plate member 510. In particular, trough 520 represents top end of portion of helical spiral adapted to fit beneath and abut carved out edge of stationary flat plate 500. Similarly, trough 530 represents lower flat surface of backflow reducer helical spiral disposed atop stationary flat plate 500, wherein upper helix portion thereof is shown with lower end cut level to enable its being emplaced atop 240° flat plate member, aligned with this carved trough. Plate member 510 is seen configured as a 120° sliding lid member that slides up and down to devolve to corresponding open or closed relationship with 240° flat plate member 500. Flat plate member 500 is depicted with 240° flat plate carved-out to follow the spiral of the helical trough 540 from below, thereby adjoining the leading edge of the trough of the upper helix. Corresponding top end of lower spiral 540 is similarly carved-out to abuttably fit under carved-out edge of flat place 500.

Referring now to FIGS. 10A-B and 10D and 11A-C, it will be evident how plurality of ball bearings comprising bearings assembly 300 enable advanced rod guide embodiment II-10 to readily adapt to hydrocarbons flow variations and concomitant perturbations in real-time. It should be understood by those skilled in the art that when the instant bearing assembly is caused to move upwards, hydrocarbons flow occurs. On the contrary, when this bearing assembly is caused to move downwards, hydrocarbons flow ceases, triggering the functionality of the integrated backflow reducer. A donut-shaped member is preferably welded to the cutting edge unless cast as an integrated component thereof, and expands into the production tubing wall via groove cut therein to enable the bearings to glide therethrough; this groove should preferably be about ¼ inch to ½ inch thick with solid metal disposed inside.

Figure 10D:
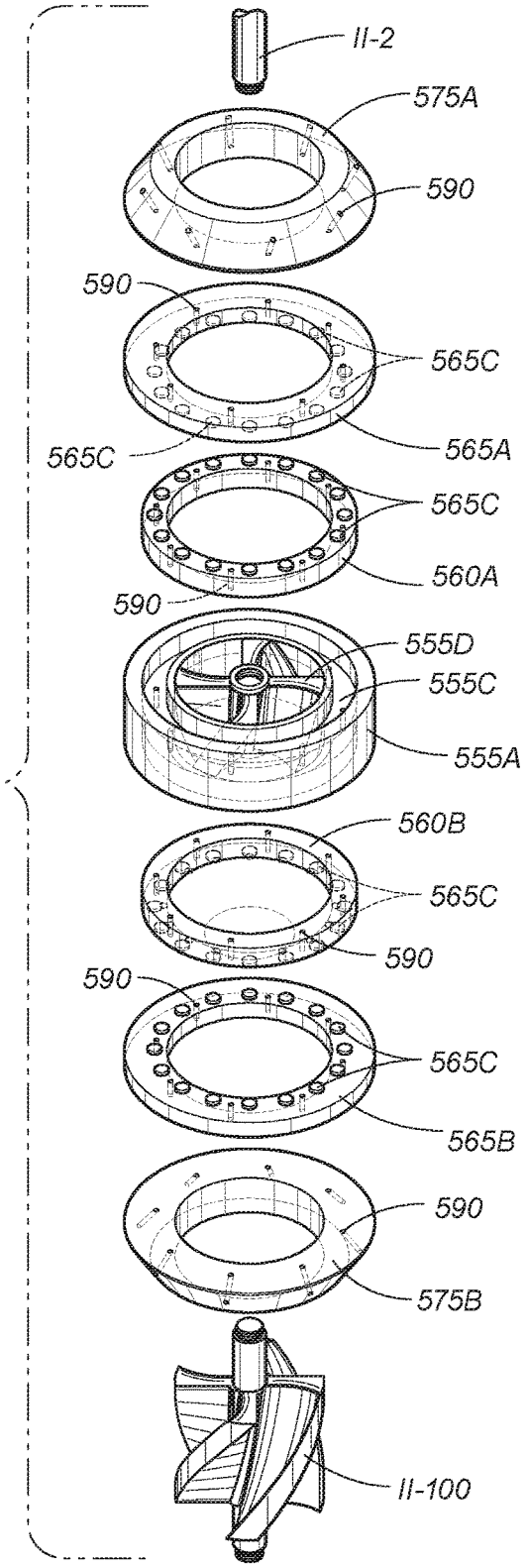
FIG. 10D depicts a frontal perspective exploded view of the backflow reducer of the embodiment depicted in FIGS. 1A and 1B, focusing on the upper bearing portion thereof and the 90° blade set positioned between the upper and lower bearing set thereof.

Expanded casing housing 570A encases solid metal flange ring 575A which is flangedly attached atop bearing/blade assembly 550A. Similarly, expanded casing housing 570B encases solid metal flange ring 575B which is flangedly attached atop bearing/blade assembly 550B. Also shown is plurality of oil ports 590 that circulate lubricating oil for optimum performance of the plurality of bearings through incoming oil line 580 and outgoing oil line 585. FIG. 10D depicts an exploded perspective view of the bearings assembly taught herein. Solid metal flange ring 575A is shown with plurality of oil ports 590, disposed atop bearing plate 565A preferably having threaded flange and plurality of bearings 565C preferably disposed upon cast metal ring 560A. Next is shown cast metal ring 555A with assembly of plurality of 45° blades 555D and associated annular bearing ring trough 555C. As will become evident to those skilled in the art, symmetrically disposed, in turn, are cast iron metal ring with plurality of bearings 560A, bearing plate having threaded flange and bearings 565A, with plurality of bearings 565C, and solid metal flange ring 575B with plurality of oil ports 590. Medially disposed between upper bearings assembly 350A and lower bearings assembly 350B is 90° blade set II-100 for performing cutting and shredding of viscous hydrocarbons, tar balls, and the like as hereinbefore described.

It has been determined that diamond bearings afford the most efficient performance contemplated hereunder, albeit being relatively expensive. For instance, U.S. Synthetic Bearing of Orem, Utah has developed a line of polycrystalline diamond bearings with panoply of properties including extreme hardness and consequent wear resistance, high thermal conductivity, high strength and toughness, and low friction. Nevertheless, it has been found that metal bearings—considerably less expensive than diamond bearings and the like—may be incorporated into embodiments hereof, but sacrificing comparable efficiency.

The angular disposition of plurality of plate members II-60 are offset from 90° for enabling uninterrupted upward hydrocarbon flow through continuous channel II-40. Bottom-level plate member II-100 is configured at a steeper angle adjacent the well bottom in order to enable snow-shovel-like combined dislodging and scooping actions to facilitate twofold functionality. First, plate member II-100 urges separation of viscous hydrocarbons II-5, e.g., tar balls and the like, from the well bottom. Second, the configuration of plate member II-100 urges entry of such dislodged and scooped viscous hydrocarbons into channel lowest level II-45 and also consequent upward travel thereof along the trough-like channel II-40. It will be appreciated that such facilitated upward travel of viscous hydrocarbons along channel II-40 is manifest on each plate member II-65 situated, in turn, on each corresponding successive helical level member of plurality of helical level members II-60, as hydrocarbons II-5 are driven to well surface 155 under high-pressure.

In order to enable contemplated efficient shredding, dislodging and scooping functions of bottom level scooping plate members II-100, it has been found that offsets ranging from about 20° to 30° are preferred; it will be understood by practitioners skilled in the art that these preferred offsets correspond to angles of about 110° to 120° relative to the horizontal. Those conversant in the art will also note that the elongated helix located at the lower plate level of plurality of plates II-60 preferably has bevel II-50 disposed on the rear of the helix. This bevel configuration tends to avoid striking production tubing II-200 in a flat disposition, thereby affording extra support thereto, and smoothly commencing and sustaining continuous upward helical movement thereof as contemplated hereunder. It will be seen that the outside edge of these cutting blades are configured to be tangent to the adjacent internal production tubing wall, thereby assuring a sufficiently tight fit therebetween. Thus, those skilled in the art will appreciate that just enough clearance is prerequisite to permit uninhibited rotation as herein described.

Each successive level member II-65 of this helical configuration should preferably be successively spaced apart equidistant in a vertical disposition with height "h" therebetween. For instance, in one application of instant multi-tasking rod guide II-10, each helix level member II-65 has been designed to measure approximately h-value of 2½ inches. With each level of helix II-65 configured to be angled upwards, there is formed a trough-like channel II-40 that tends to guide the pressure-driven continuous flow of fluid hydrocarbons II-5 upwardly as helical portion II-30 is caused to rotate synchronously with hydrocarbons II-5 within concentrically situated interior wall II-225 of production tubing II-200. Hydrocarbons II-5 ultimately reach atop axial pumping rod II-2 near well surface 155 and tend to be delivered via a squirting and spraying action thereof atop plurality of helix level members, which serves as a collection plate thereat.

Figure 12:
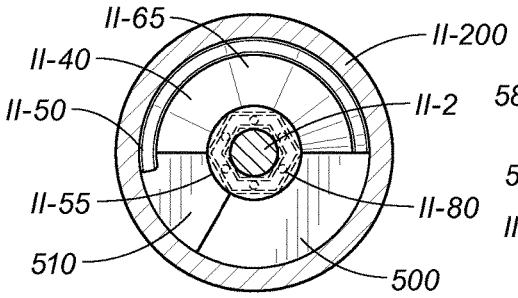
FIG. 12 depicts a top view of the backflow reducer embodiment depicted in FIG. 11A along line 12-12'.

FIGS. 12-16 depict various views of backflow reducer aspect II-80 of lateral bearings rod guide embodiment II-10. More particularly, FIG. 12 is a top view of the instant backflow reducer depicted in FIG. 11A along line 3-3'. Upper helix 530 with lower end cut level to be snugly seated atop 240° flat plate 500 is seem aligned with curved trough 540. Flat plate member 500 is carved out to follow the spiral of the trough from below, and then to meet the leading edge of upper helix trough. 120° sliding lid member 510—slides up and down—opening and closing its functional relationship with 240° flat plate member 500. Top end of lower spiral 520 is carved out to fit under and abut carved-out edge of flat plate 500.

Figure 13:
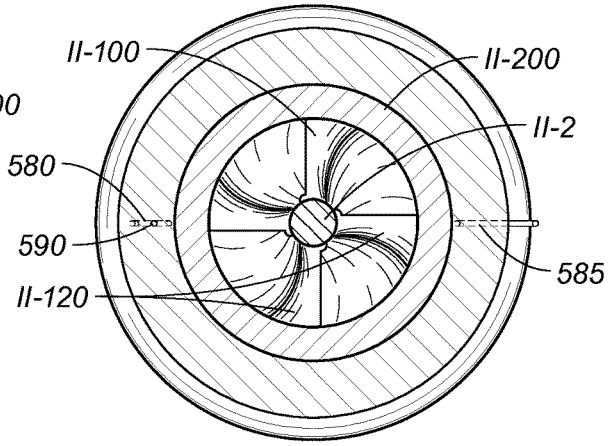
FIG. 13 depicts a top view of the backflow reducer embodiment depicted in FIG. 11A along line 13-13'.

FIG. 13 depicts a top view of the backflow reducer embodiment II-80 of advanced rod guide embodiment II-100 depicted in FIG. 11A along line 4-4'. Shown therein are rod II-2, production tubing II-200, upper helix trough 120. Also shown therein is the fluid relationship between plurality of oil ports 590 and incoming lubricating oil line 580 and outgoing lubricating oil line 585.

Figure 14:
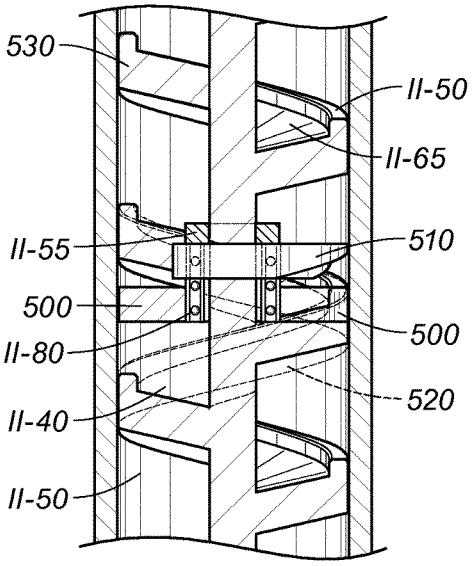
FIG. 14 depicts an enlarged partial side cross-sectional view of the backflow reducer embodiment depicted in FIG. 11A, in the open position.
Figure 15:
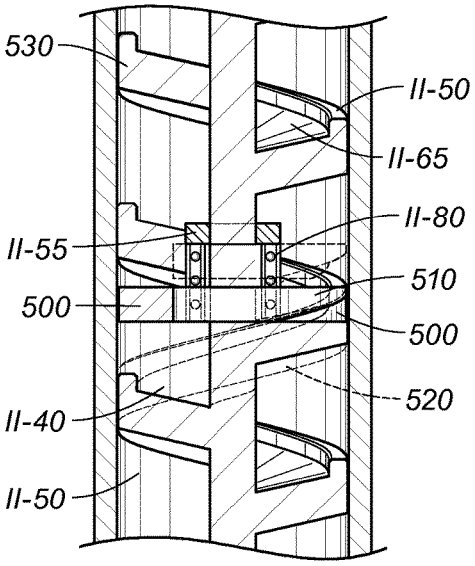
FIG. 15 depicts an enlarged partial side cross-sectional view of the backflow reducer embodiment depicted in FIG. 11B, in the closed position.
Figure 16:
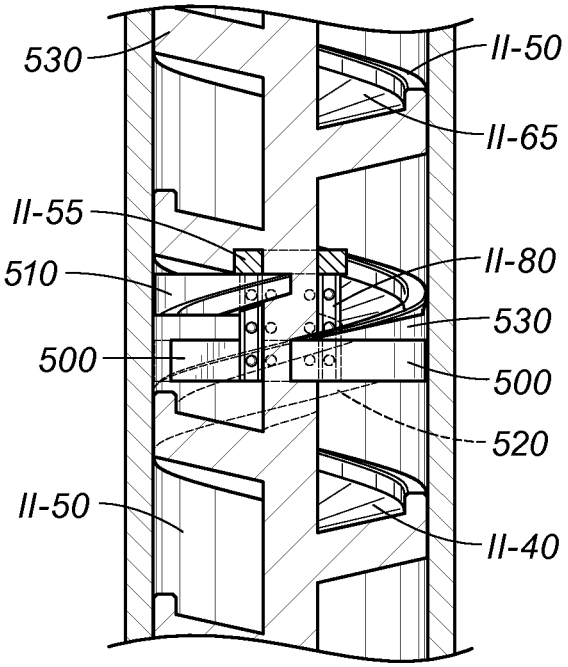
FIG. 16 depicts an enlarged partial side cross-sectional view of the backflow reducer embodiment depicted in FIG. 11C, in the open position.

Now focusing on FIG. 14, there is depicted an enlarged partial side cross-sectional view of backflow reducer embodiment II-80 depicted in FIG. 11A—in an open position. Similarly, it will be appreciated that FIG. 15 depicts an enlarged partial side cross-sectional view of the instant backflow reducer embodiment depicted in FIG. 11B—in a closed position. As further amplification of the backflow reduction member taught hereunder, FIG. 16 depicts an enlarged partial side cross-sectional view thereof the backflow reducer embodiment disposed in the open position rotated 90° counterclockwise. The functional relationship between mated members plate 500 and 510 is illustrated, wherein it should be evident that flat plate member 500 is carved-out to follow the spiral configuration of the implicated trough from below, and, in so doing, adjoin the leading edge of the trough of the upper helix. Plate member 510, functioning as a lid or the like, slides upwardly and downwardly to engender the crucial open or closed condition. It will, of course, be appreciated by those skilled in the art that the instant closed condition is manifest when flat plate 500 and lid plate 510 are urged to be conjoined and effectuate a seal by closing the circle, i.e., achieving 360° coverage, when the 240° member snuggly mates with the 120° member, respectively. Hence, backflow is restricted and substantially attenuated. As an example, it has been found that a ¾ inch 240° flat plate and a ¾ inch 120° sliding lid plate, especially constructed from a preferred alloy such as Iconel manufactured by Special Metals Corporation or the like. But, it should be clearly understood that other materials of construction may be used to implement the advanced rod guide embodiments taught hereunder, other alloy materials and the like may be invoked to achieve satisfactory results as herein described.

Referring now collectively to FIGS. 17-25, there is depicted preferred embodiment of the advanced multi-function rod guide configured with both a streamline or linear arrangement of bearings and an integrated backflow reducer. It will be readily appreciated by those conversant in the downhole art that the embodiment of the present invention depicted in FIGS. 17-25 effects hydrocarbons flow differently than the bearings embodiment of the present invention depicted in FIGS. 10-16. As hereinbefore described, the advanced rod guide depicted in FIGS. 10-16 is specially configured to accommodate lateral or horizontal fracking or other hydrocarbons recovery methodology that first receives released viscous and semi-fluid hydrocarbons from laterally-disposed formations, and then urges such released hydrocarbons uphole. On the other hand, the advanced rod guide depicted in FIGS. 10-16 is specially configured to accommodate streamline uphole flow of fluid hydrocarbons emanating from downhole wherein linear or laminar flow thereof is sustained until the well surface is reached.

Figure 17:
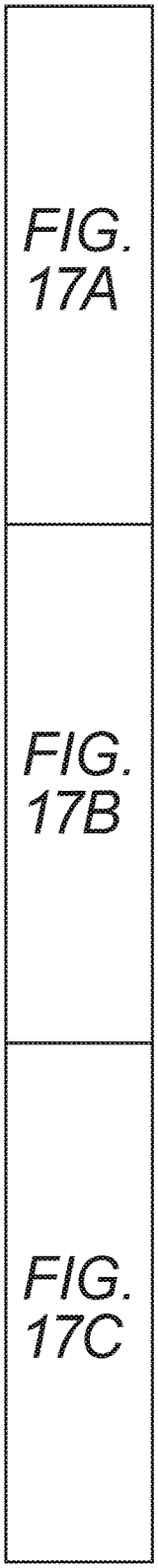
FIG. 17 is a diagram showing the orientation of partial FIGS. 17A-C depicting another multi-tasking rod guide embodiment, with half of the well casing removed and having an integrated streamline bearing member and an integrated backflow reducer member disposed in an open position.
Figure 17A:
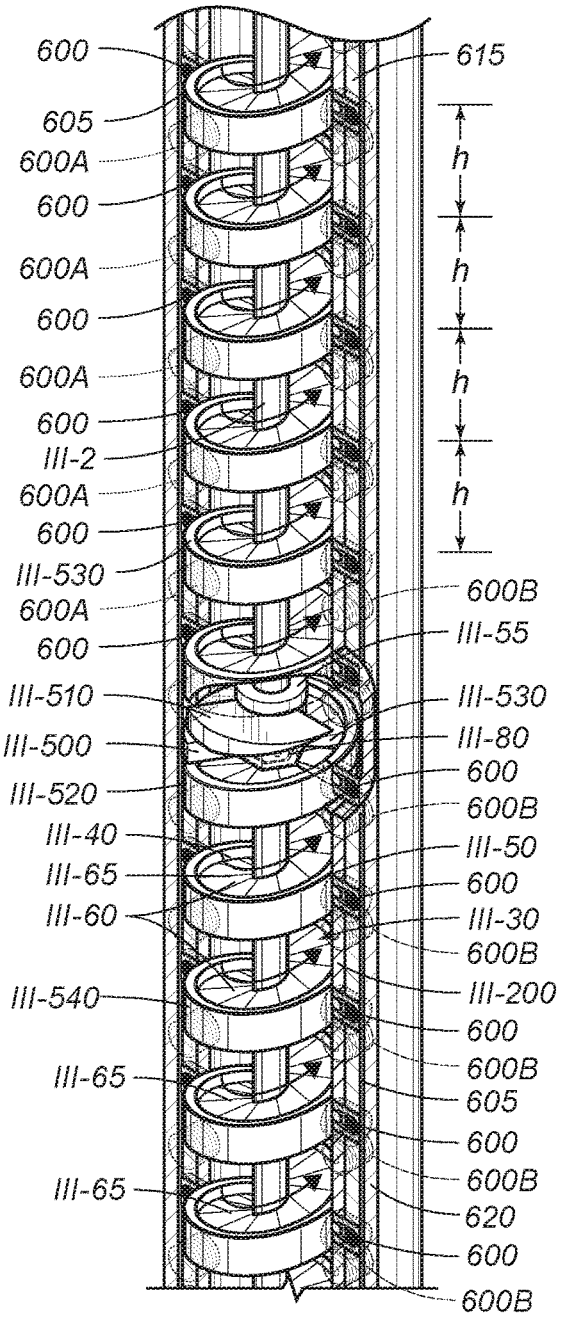
FIG. 17A depicts a partial cut-away perspective view of the portion of the multi-tasking rod guide embodiment as indicated in FIG. 17.
Figure 17B:
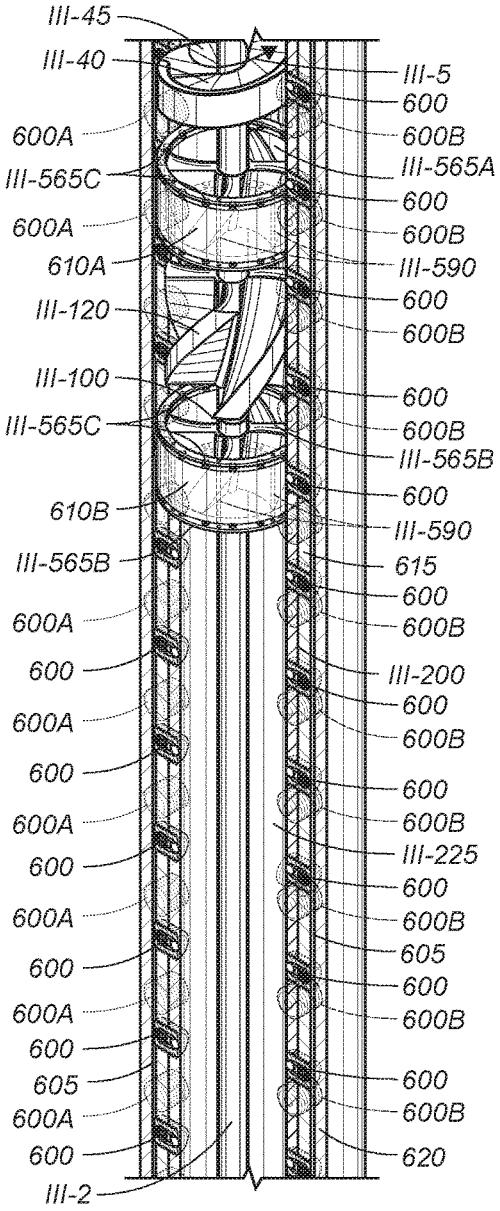
FIG. 17B depicts another partial cut-away perspective view of the portion of the multi-tasking rod guide embodiment as indicated in FIG. 17.
Figure 17C:
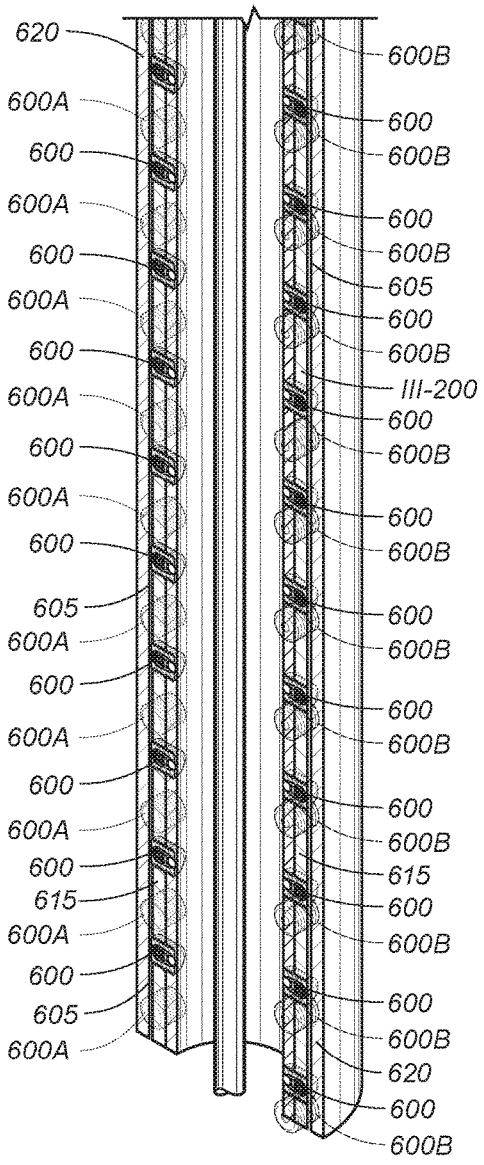
FIG. 17C depicts another partial cut-away perspective view of the portion of the multi-tasking rod guide embodiment as indicated in FIG. 17.
Figure 17D:
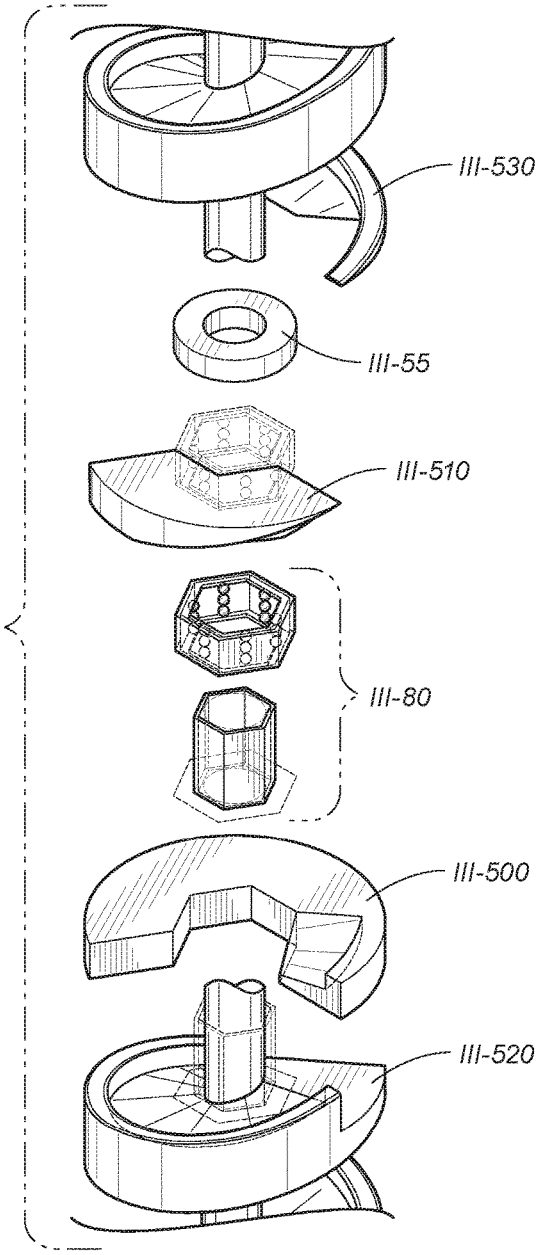
FIG. 17D depicts a frontal perspective exploded view of the backflow reducer of the embodiment depicted in FIGS. 17A-C, focusing on the portion thereof that opens and closes to control hydrocarbons flow.

Referring now to FIG. 17, there is shown a diagram indicating the orientation of partial various partial views depicted in FIGS. 17A-C depicting another multi-tasking rod guide embodiment, with half of the well casing removed and having an integrated streamline bearing member and an integrated backflow reducer member disposed in an open position. Likewise, FIG. 18 shows a diagram indicating the orientation of partial various partial views in FIGS. 18A-C depicting this integrated streamline another multi-tasking rod guide embodiment, with half of the well casing removed and having an integrated streamline bearing member and an integrated backflow reducer member disposed in a closed position. Collectively referring to this instant streamline-configured embodiment shown in FIGS. 17A-E and 18A-C, there is seen rod III-2 circumscribed by this streamline advanced rod guide embodiment. Upwardly flowing hydrocarbons III-5 are shown flowing via helical structured channel III-40 as taught hereunder. Second production tubing string 615, lubricating oil channel, with lubrication check valves 600. Outer production tubing string 620 is shown with four lubrication channels. Plurality of bearing members III-565 is disposed upon bearing plate III-565A preferably having threaded flange for attachment to cast metal ring 610A cut to accommodate the 45° blade assembly. Blade assembly is preferably configured with 45° cutting and shredding blades in order to assure sustained uninterrupted laminar uphole flow of fluid hydrocarbons. As hereinbefore described, shredding blade assembly is disposed medially of an upper and lower bearing assembly comprising bearing plates III-565A-B and affixed cast metal rings III-610 A-B, respectively, which move up and down to accommodate any perturbations to streamline uphole flow hydrocarbons. Akin to the hereinbefore described breakdown of the components' interrelationships as depicted in FIG. 10C, the same interrelationships are manifest for the embodiment depicted in FIG. 17D for like components.

Figure 17E:
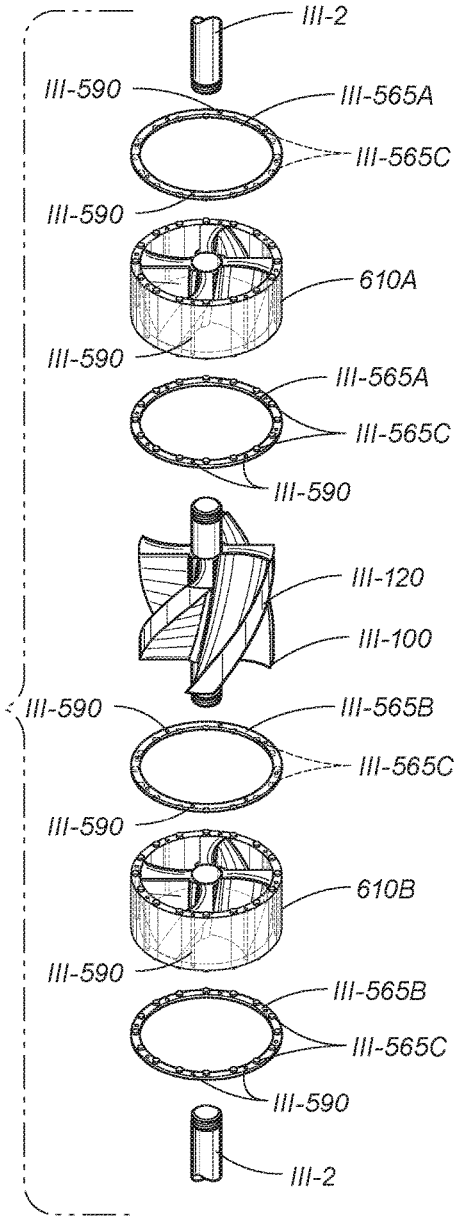
FIG. 17E depicts a frontal perspective exploded view of the backflow reducer of the embodiment depicted in FIGS. 17A-C, focusing on the bearings assembly thereof.
Figure 18:
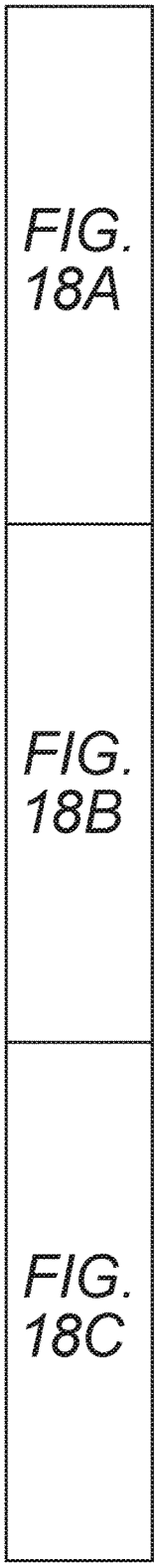
FIG. 18 is a diagram showing the orientation of partial FIGS. 18A-C depicting the multi-tasking rod guide embodiment, with half of the well casing removed and having an integrated streamline bearing member and an integrated backflow reducer member depicted in FIGS. 17A-E, disposed in a closed position.
Figure 18A:
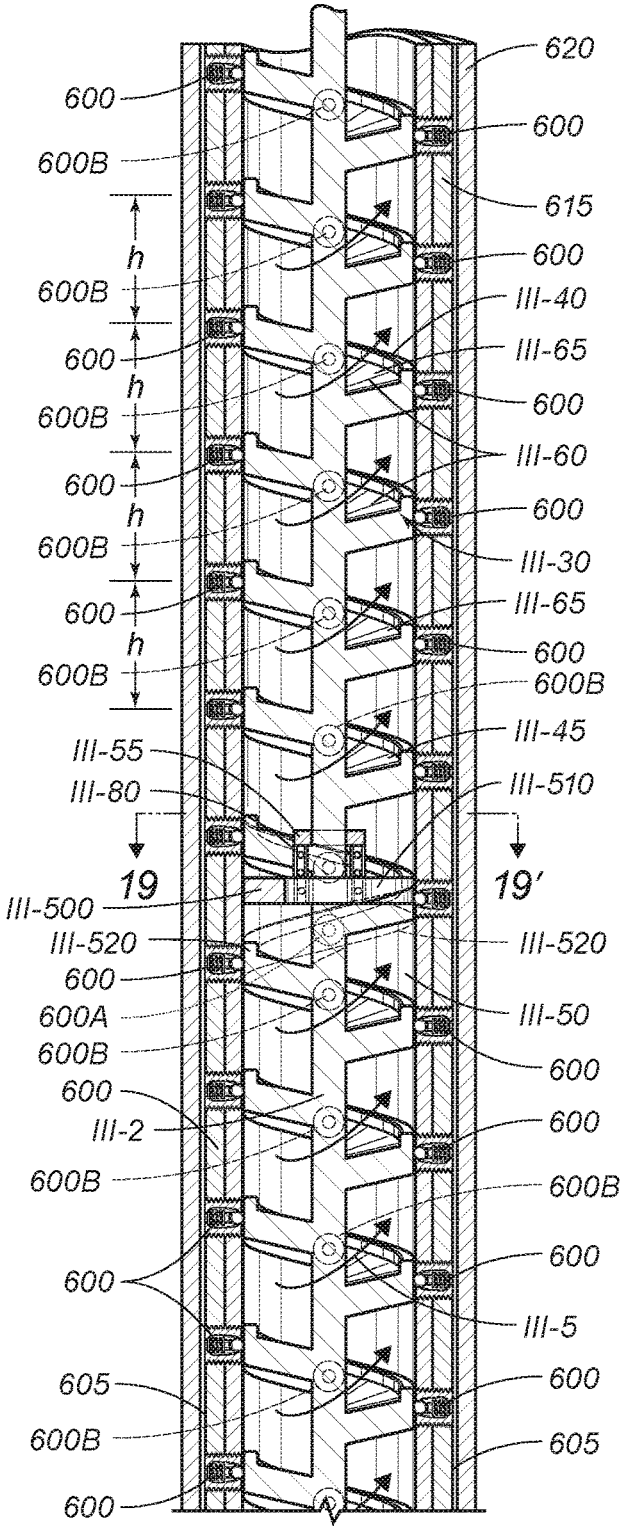
FIG. 18A depicts a partial cut-away perspective view of the portion of the multi-tasking rod guide embodiment as indicated in FIG. 18.
Figure 18B:
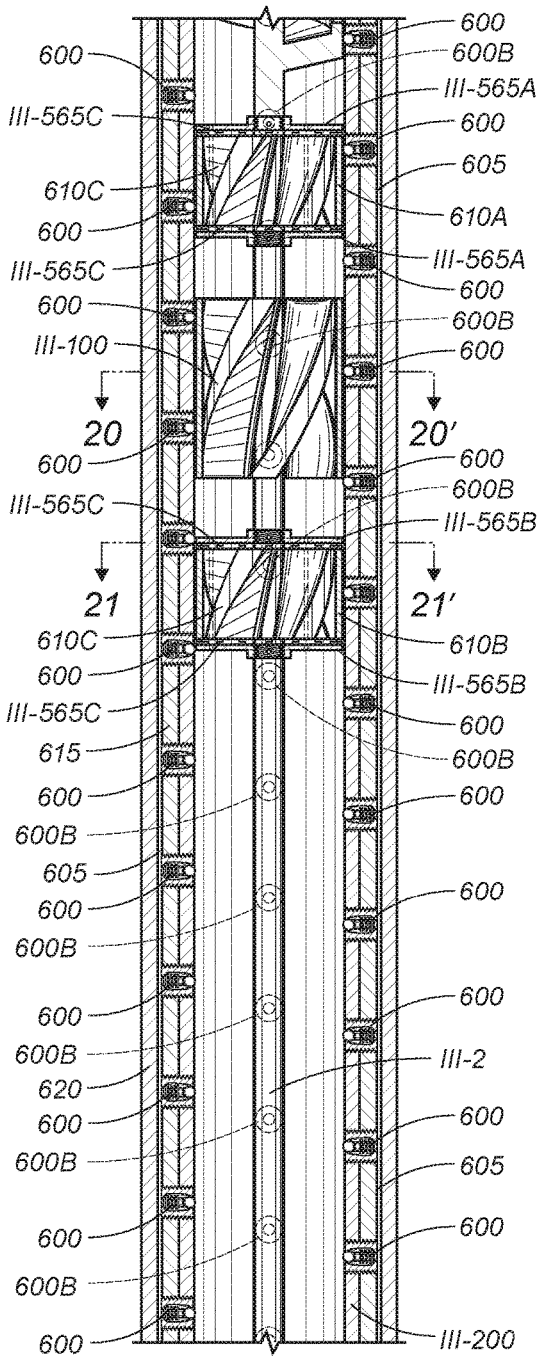
FIG. 18B depicts another partial cut-away perspective view of the portion of the multi-tasking rod guide embodiment as indicated in FIG. 18.
Figure 18C:
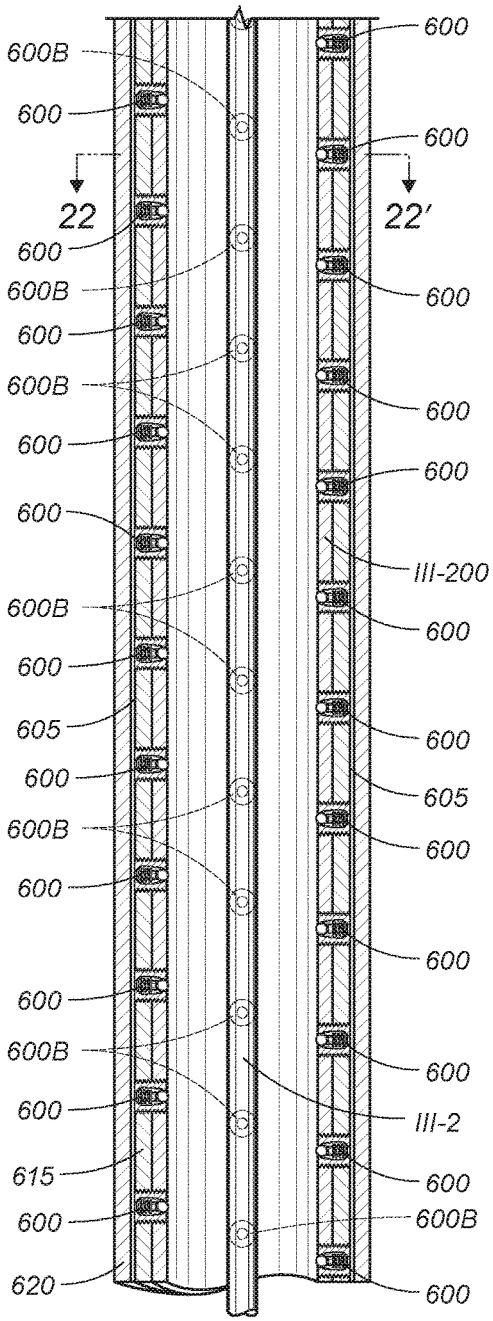
FIG. 18C depicts another partial cut-away perspective view of the portion of the multi-tasking rod guide embodiment as indicated in FIG. 18.

Those skilled in the art will recognize that the components common to the embodiments depicted in FIGS. 10D and 17E are the same, but the arrangement thereof are different. Thus, in FIG. 17E there is depicted rod III-2 passing axially through bearing plate member III-565A attached to threaded flange and comprising plurality of bearings III-565C and plurality of oil ports III-590. Bearing plate III-565A is, in turn, threadedly attached to cast metal ring member 610A comprising plurality of preferably 45° blades III-100. Between ring member 610A and plurality of 45° blades sharp-edged blades III-120 is another bearing plate III-565C comprising plurality of bearings III-565C and plurality of oil ports III-590. Same series of components is affixed on opposite side of plurality of 45° blades sharp-edged blades III-120, namely, in turn, first bearing plate member III-565B, cast metal ring member III-610B, and second bearing plate member III-565B.

As disclosed herein, embodiments of the backflow reducer aspect of the present invention enable fluid hydrocarbons to continuously flow upwardly within the production string without being inhibited by contra-flowing hydrocarbons. It has been found that a hexagonal configuration having a plurality of rollers or like bearings affixed on at least two of its sides thereof is advantageous for promoting uninhibited rotational movement urged by and synchronized within auspices of rod guide embodiments contemplated hereunder. It will hence become evident that bearings embodiments of the present invention are configured with an integrated bearings assembly suitable for assuring rod guide performance heretofore unknown in the art regardless of whether inhibitions to upward flow of fluid hydrocarbons occur in situ. Its bearings infrastructure enables dynamic rising and/or lowering of the helical trough member functionally related to ongoing hydrocarbon flow conditions. This dynamic real-time accommodation to hydrocarbons flow conditions had been found to synergistically enhance the effectiveness of backflow attenuator members contemplated hereunder.

Figure 8:
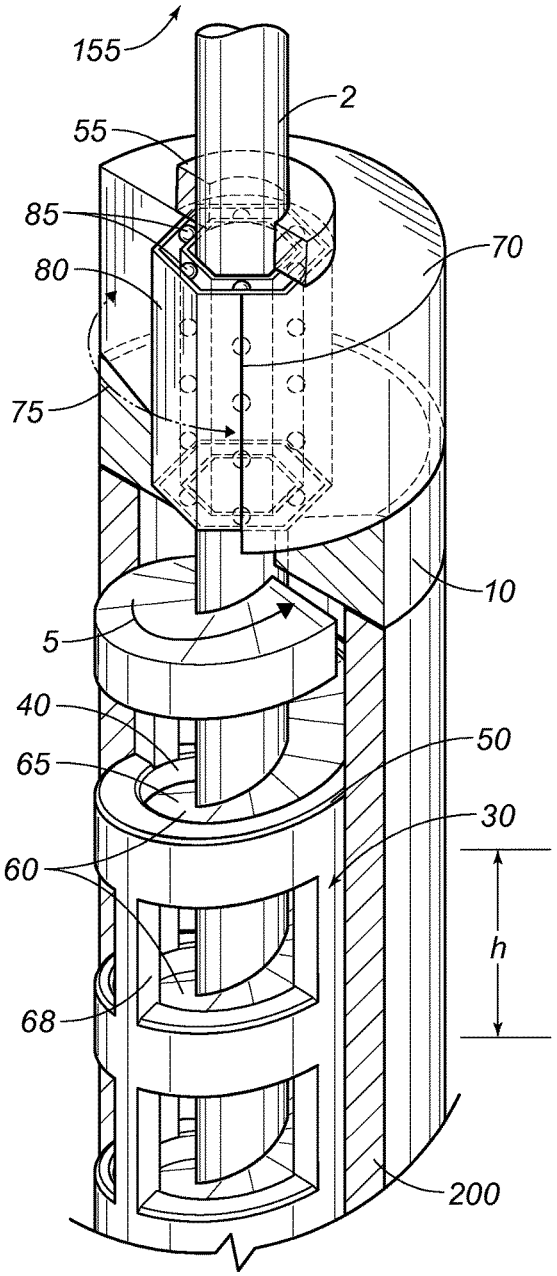
FIG. 8 depicts a frontal perspective view of a portion of the multi-tasking rod guide embodiment depicted in FIG. 1, featuring the backflow reducer contained in the top thereof.
Figure 9:
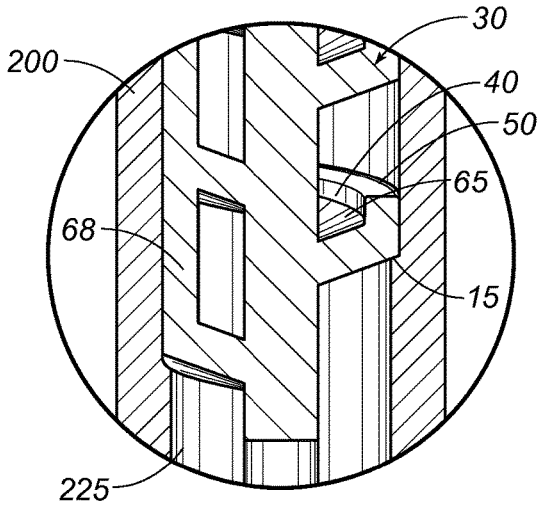
FIG. 9 depicts a frontal perspective view of a portion of the multi-tasking rod guide embodiment depicted in FIG. 2, featuring an intermediate plate member of its plurality of intermediate plate members.

It has been found that, while a configuration of 6-8 sides seems to afford a sufficiently secure seal, having a configuration of six sides is adequate and effectuates the intended backflow reduction contemplated hereunder. FIGS. 8, 10C and 17D illustrate this preferred hexagonal configuration. Furthermore, as herein illustrated, two sets of a plurality of bearings positioned at two different parallel locations on the instant helical trough taught herein achieve the contemplated advanced rod guide functionality. For each embodiment disclosed herein, plurality of bearings are disposed in a pair of bearings sets, with each bearings set being displaced from and parallel to the other bearings set (See FIGS. 10A-B, 11A-C, 17B, 18B). It will be appreciated that two such bearings sets afford optimum distribution of the implicated load manifest by and associated with hydrocarbons fluid flow, on the basis of promoting the absence of lateral rod movement attributable to wobbling and the like.

It is also an aspect of the present invention that the fit of backflow reducer embodiments should preferably be essentially flush with of production tubing interior walls or include beveled members to inherently attenuate hydrocarbons backflow so long as power is being supplied to the downhole pump system. Thus, where hydrocarbons enter atop the instant plurality of helix plate members by a squirting and spraying action thereonto, backflow reducer embodiments should preferably fit snugly so as to securely seal hydrocarbons collected thereatop. As hereinbefore described, corresponding flat plate member and lid sliding plate member are urged to form a complete 360° circle, thereby closing the fluid hydrocarbons flow path within the helical trough taught herein.

Based upon conditions prevalent in the downhole art, those skilled in the art will appreciate that it should generally be advantageous to provide the helical structure of the present invention with sides of ¾ to 1 inch width in order to achieve contemplated structural stability prerequisite for minimizing or even eliminating lateral movement thereof. In addition, it will also be understood that the clearance range of embodiments of the present invention are relatively small because of the extremely high pressures manifest during contemplated pumping of hydrocarbons toward the well surface. Indeed, based upon observations and experience in the art, a clearance as small as 0.01 inch may be too large and thus may be inadequate to be compatible with the protocol herein described.

Accordingly, preferred embodiments of the present invention should have a clearance range of only about 0.155 to 0.005 inch to effectively perform. That is, affording a tight fit between the exterior of rod guide embodiments of the present invention and production tubing interior surfaces is crucial to the successful heretofore unrealized efficient upward flow of hydrocarbon fluid. In conjunction with the stable structures taught hereunder, such close tolerances prevent lateral shimmy or waddle effects or slipping of rod guide embodiments annularly disposed between the pump rod and production tubing, thereby wholly avoiding consequent damage to production tubing attributable to scoring by grit and like foreign solid matter situated in situ with hydrocarbons streaming upwardly to the well surface at high speeds and under high pressures.

Practitioners familiar with adverse viscosity conditions in Venezuela and similar exigent environments, wherein tar and likewise viscous materials are unavoidably present, will appreciate the novel functionality, as depicted in FIGS. 1 and 2, of the bottom-level member comprising plurality of specially-configured blades 120 having sharp rib-like and blade-like members for inherently simultaneously cutting into and dislodging viscous, semi-solid and liquid hydrocarbons. It should be evident that such cutting and dislodging of viscous, semi-solid hydrocarbons tends to promote upward hydrocarbons flow—under the influence of downhole pumping known in the art—but also reinforced by the auxiliary pumping action taught by the present invention. It will also be appreciated that, during fracking operations at predetermined well-depths, released hydrocarbons may be unavoidably intertwined with tar and likewise viscous materials, so that, as depicted in FIGS. 10A-B, a rod guide embodiment configured with an intermediate-level member, i.e., situated in the production string at a commensurate height downhole, comprising plurality of specially-configured blades having sharp rib-like and blade-like members for inherently simultaneously cutting into and dislodging viscous, semi-solid and liquid hydrocarbons, thereby promoting upward flow thereof—under the influence of downhole pumping known in the art—but reinforced by the auxiliary pumping action taught by the present invention.

Figure 19:
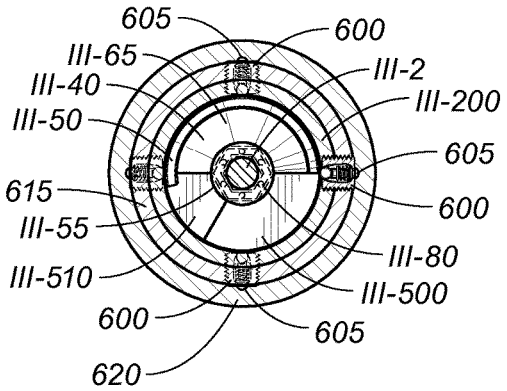
FIG. 19 depicts a perpendicular cross-sectional view of 19-19' as shown in FIG. 18A.
Figure 20:
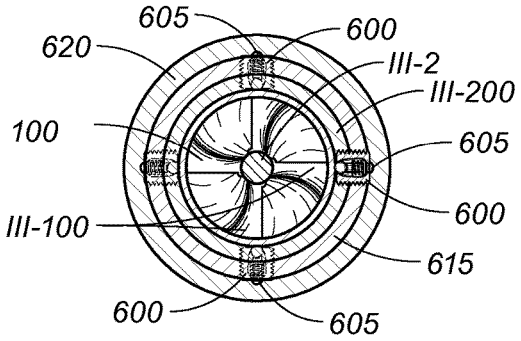
FIG. 20 depicts a perpendicular cross-sectional view of 20-20' as shown in FIG. 18B.
Figure 21:
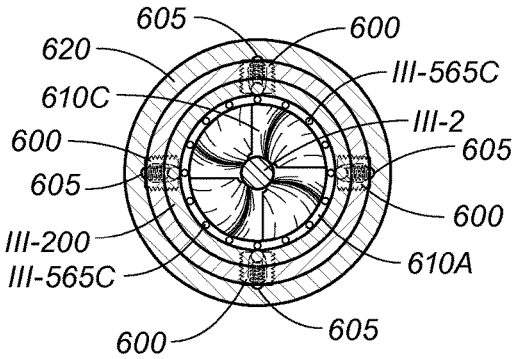
FIG. 21 depicts a perpendicular cross-sectional view of 21-21' as shown in FIG. 18B.
Figure 22:
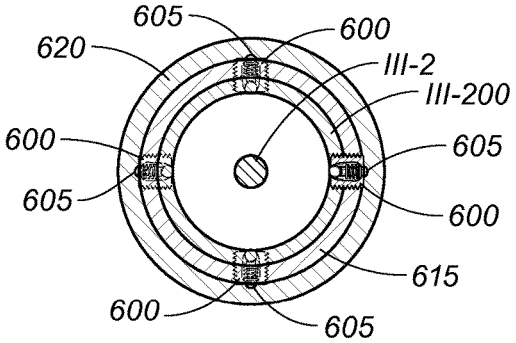
FIG. 22 depicts a perpendicular cross-sectional view of 22-22' as shown in FIG. 18C.

Referring now to FIGS. 19-22, there is shown perpendicular cross-sectional views taken as shown at different levels of the embodiment hereof depicted in FIGS. 18A-C, respectively. Thus, FIG. 19 depicts a cross-sectional view immediately above backflow reducer member III-80 (FIG. 18A) disposed in a closed position. Stationary plate member 500 and sliding plate member 510 are shown as being snugly adjoined, thereby encompassing a completely closed circle manifest by the joinder of the 240° flat member 500 and the 120° slidable member 510. FIG. 20 depicts a cross-sectional view within cutting blade III-100. Clearly shown is plurality of cutting blades III-120 and implicated components related to lubrication channels 605 and check valve 600 within outer production tubing string 620, and second production tubing string 615. FIG. 21 depicts a cross-sectional view atop lower bearing assembly (FIG. 18B) depicting plurality of bearing members III-565C upon cast metal ring members 610A-B including plurality of shredding blades affixed thereto. Also shown are production tubing strings 620 and 615, and implicated lubrication components taught hereunder, namely, lubrication channel 605, plurality of lubrication check valves 600. FIG. 22 depicts a cross-sectional view of downhole production tubing absent an embodiment of hereof. Hence, shown therein is rod III-2 circumscribed by production tubing III-200 and then by successive ancillary production tubing strings 615 and 620. It will be seen that outer ancillary production tubing string 620 comprises preferably four lubrication channels 605.

Figure 23:
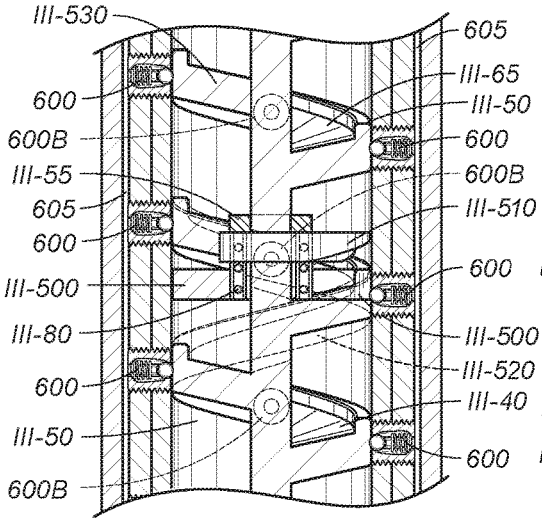
FIG. 23 depicts an enlarged detail of integrated backflow reducer member of the multi-tasking rod guide embodiment having an integrated streamline bearing member, with the backflow reducer member disposed in an open position.
Figure 24:
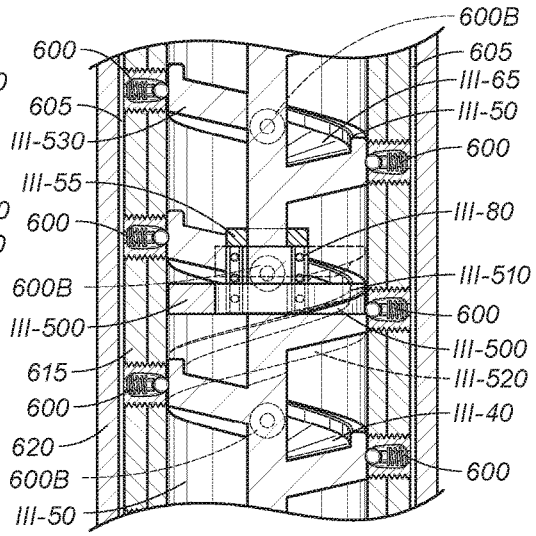
FIG. 24 depicts an enlarged detail of integrated backflow reducer member of the multi-tasking rod guide embodiment having an integrated streamline bearing member, with the backflow reducer member disposed in a closed position, as depicted in FIG. 18A.
Figure 25:
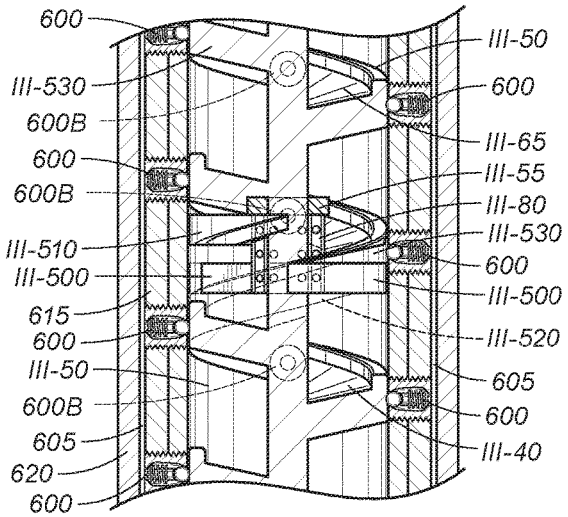
FIG. 25 depicts an enlarged detail of integrated backflow reducer member of the multi-tasking rod guide embodiment having an integrated streamline bearing member, with the backflow reducer member disposed in an open position rotated 90° counterclockwise.

Now referring to FIGS. 23-25, there are depicted enlarged detail views of integrated backflow reducer member of the multi-tasking rod guide embodiment having an integrated streamline bearing member, with the backflow reducer member disposed in an open position or closed position. In particular, FIG. 23 depicts the instant backflow reducer disposed in an open position manifest by 90°-120° gap clearly shown between flat stationary plate member 500 and sliding plate member 510. Contrariwise, FIG. 24 depicts an enlarged detail view of the instant backflow reducer disposed in a closed position, as shown in FIG. 18A, manifest by 120° sliding plate member 510 moving adjacent 240° flat stationary plate member 500, thereby essentially reducing the gap therebetween to zero, resulting in a complete 360° plug of the gap. FIG. 25 depicts another enlarged detail view of the instant backflow reducer disposed in an open position emphasized by rotating the view of FIG. 23 by 90°.

By comparing the relative disposition of each of the implicated components that are functionally related to plate members 500 and 510 of backflow reducer III-80, the effect upon closure of the 90°-120° gap is clearly illustrated. Thus the impact of sliding plate member 510 being urged to abut and engage stationary plate member 500 and thereby close the gap therebetween may be understood by consideration of the relative change in disposition backflow reducer components: 520, corresponding to top end of lower spiral carved out to fit under and abut carved-out edge of 240° flat plate; 530, corresponding to upper helix with lower end cut level to sit atop 240° stationary plate member 500, aligned with carved trough; component; 540, corresponding to lower helix just below backflow reducer; 550A-B, corresponding to upper and lower metal ring with combination of bearings, cutting blades and flange; 555A-B, corresponding to cast metal ring members comprising 45° blades and troughs cut to accommodate bearing rings; 555C, corresponding to bearing ring trough; 555D, corresponding to 45° blade assembly, with each blade member preferably 3 inches long; 600, corresponding to lubrication check valve; 605, corresponding to lubrication channel; 615 and 620, corresponding to production tubing strings.

Those skilled in the art will appreciate that the present invention seals off the high-pressures that are engendered downhole and that drive hydrocarbons to the well surface, and, in so doing, inherently restricts direct pressure from being imposed upon vertical side wall by deflecting direct pressure thereupon. There is no bleed-over manifest on the sides thereof, shielding the sides from astronomically high pressures from the surface.

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the present invention is to be measured by the scope of the appended claims herein.

What is claimed is:

1. In a well having a pump rod interconnected with a downhole pump for pumping hydrocarbons from a subsurface formation to the surface of said well, and having a tubular production string circumscribing said pump rod, a multi-tasking rod guide apparatus disposed annularly of said production string and said pump rod, said multi-tasking rod guide apparatus comprising:

a helical member configured with a continuous helix elongated in a vertical orientation and its outer surface having a tight fit with the inner surface of said tubular production string manifest by a clearance in the range 0.005 to 0.155 inch, and having a first plurality of successive plate members, with each said plate member having a collection plate and an adjacent continuous trough-like channel to enable continuous upward flow of said hydrocarbons to said well surface;

said first plurality of successive plate members disposed intermediately of a first-level collection plate member and a second-level dislodging member;

said first-level collection member configured with walls having thickness and strength to afford sufficient stability thereto for withstanding pressurized squirting and spraying action of said upwardly flowing hydrocarbons into said collection plate member thereof and to receive said continuous upward flow of said hydrocarbons for delivery thereof at said well surface;

said second-level dislodging member configured to dislodge said hydrocarbons from said downhole formation and to urge said dislodged hydrocarbons upwardly into said continuous trough-like channel;

said multi-tasking rod guide synchronously rotating with said hydrocarbons as said hydrocarbon flow upwardly through said continuous trough-like channel within said production string of said well, while simultaneously centralizing said pump rod; and said elongate continuous helix further comprising an intermediate-level plate member having at least a hexagonally-configured backflow reduction assembly comprising at least two series of rollers disposed on each of two opposing sides thereof to facilitate rotational movement thereof, for enabling said intermediate-level plate member to accommodate said incoming stream of hydrocarbons and to reduce backflow thereof.

2. The multi-tasking rod guide apparatus recited in claim 1, wherein each said plate member of said first plurality of collection plate members further comprises a second plurality of pillar members disposed vertically between each successive neighboring plate member to afford strength thereto as said pressurized upwardly-flowing hydrocarbons pass through said continuous trough-like channel and adjacent said plurality of collection plate members.

3. In a well having a pump rod interconnected with a downhole pump for pumping hydrocarbons from a subsurface formation to the surface of a well, and having a tubular production string circumscribing said pump rod, a multi-tasking rod guide apparatus disposed annularly of said production string and said pump rod, said multi-tasking rod guide apparatus comprising:

a helical member configured with a continuous helix elongated in a vertical orientation and its outer surface having a tight fit with the inner surface of said tubular production string manifest by a clearance in the range 0.005 to 0.155 inch, and having a first plurality of successive plate members, with each said plate member having a substantially horizontal collection plate and being substantially identical with each other said plate member thereof and being spaced-apart the same height from each other, and further configured with an adjacent continuous trough-like channel to enable continuous upward flow of said hydrocarbons to said well surface;

said first plurality of successive plate members disposed intermediately of a first-level collection plate member and a second-level dislodging plate member;

said first-level collection plate member configured to receive said continuous upward flow of said hydrocarbons for delivery thereof at said well surface;

said second-level dislodging plate member configured to dislodge said hydrocarbons from said downhole formation and to urge said dislodged hydrocarbons upwardly into said continuous trough-like channel;

a subset of said first plurality of successive plate members comprising at least a hexagonally-configured backflow reduction assembly comprising at least two series of rollers disposed on each side of two opposing sides thereof to facilitate rotational movement thereof, for enabling said incoming stream of hydrocarbons to be accommodated and to reduce backflow thereof; and said multi-tasking rod guide adapted to synchronously rotate with said hydrocarbons as said hydrocarbons flow upwardly through said continuous trough-like channel within said production string of said well, while simultaneously centralizing said pump rod.

4. The multi-tasking rod guide apparatus recited in claim 3, wherein said first plurality of successive plate members of said continuous helix is configured with each said plate member preferably an offset of 110° to 120° relative to the horizontal.

5. The multi-tasking rod guide apparatus recited in claim 4, wherein said hydrocarbon flow upwardly through said continuous trough-like channel is achieved by pressurized movement of said hydrocarbon from said second-level dislodging member successively to one said plate member of said first plurality of successive plate members to the next upper said plate member of said first plurality of successive plate members, until said first-level collection plate member is reached for delivery of said upwardly flowing hydrocarbon to said well surface.

6. The multi-tasking rod guide apparatus recited in claim 5, wherein said dislodging second-level member comprises a second plurality of blade-like and rib-like members for dislodging and scooping said viscous hydrocarbons from said subsurface formation and for urging said dislodged hydrocarbon into said trough-like channel disposed at said well-bottom or at a predetermined hydraulic fracturing well-level.

7. The multi-tasking rod guide apparatus recited in claim 6, wherein said first-level collection plate member is configured with walls having thickness and strength greater than the corresponding walls of each plate member of said first plurality of plate members, for enabling said first-level member to afford sufficient stability thereto for withstanding pressurized squirting and spraying action of said upwardly-flowing hydrocarbons into said collection plate thereof.

8. The multi-tasking rod guide apparatus recited in claim 7, wherein said first-level collection plate member is configured with a substantially horizontal top opening to enable uninhibited pressurized collection of said hydrocarbons driven upwardly through said trough-like channel member via said pressurized squirting and spraying action onto said first-level collection plate for ultimate deposit thereof at the well surface.

9. The multi-tasking rod guide apparatus recited in claim 8, wherein said opening of said first-level collection plate member is configured with said substantially horizontal top opening corresponding to about ⅓ of said top-level collection plate, preferably encompassing from 90° to 120° thereof.

10. The multi-tasking rod guide apparatus recited in claim 9, wherein said backflow reducer assembly comprises a first circular stationary plate member having an arc of about 240° and a corresponding mated second circular slidable lid plate member having an arc of about 120°.

11. The multi-tasking rod guide apparatus recited in claim 10, wherein said hydrocarbons backflow is reduced when said first circular stationary plate member and said second circular slidable lid plate member are disposed in a mated relationship wherein there is no gap therebetween.

12. The multi-tasking rod guide apparatus recited in claim 11, wherein said hydrocarbons backflow is unaffected when said first circular stationary plate member and said second circular slidable lid plate member are disposed in a separated relationship of about 90° to 120°, wherein a gap is manifest therebetween.

13. The multi-tasking rod guide apparatus recited in claim 12, wherein each said plate member of said first plurality of collection plate members further comprises a plurality of pillar members disposed vertically between each successive neighboring plate member to afford strength thereto as said pressurized upwardly-flowing hydrocarbons pass through said continuous trough-like channel and adjacent said plurality of collection plate members.

14. The multi-tasking rod guide apparatus recited in claim 13, wherein said helical member further comprises a bevel member located upon its rear surface, to avoid striking said production tubing in a flat disposition, thereby affording extra support thereto, and promoting uninhibited continuous upward helical movement thereof.

15. In a well having a pump rod interconnected with a downhole pump for pumping hydrocarbons from a subsurface formation to the surface of a well, and having a tubular production string circumscribing said pump rod, a multi-tasking rod guide apparatus disposed annularly of said production string and said pump rod, said multi-tasking rod guide apparatus comprising:

a helical member configured with a continuous helix elongated in a vertical orientation and its outer surface having a tight fit with the inner surface of said tubular production string manifest by a clearance in the range 0.001 to 0.005 inch, and having a first plurality of successive plate members, with each said plate member having a substantially horizontal collection plate and being substantially identical with each other said plate member thereof and being spaced apart the same height from each other, and further configured with an adjacent continuous trough-like channel to enable continuous upward flow of said hydrocarbons to said well surface;

said first plurality of successive plate members disposed intermediately of a first-level collection plate member and a second-level dislodging plate member;

said first-level collection plate member further comprising configured with walls having thickness and strength for enabling said top-level member to afford sufficiently stability thereto for withstanding pressurized squirting and spraying action of said upwardly-flowing hydrocarbons into said first-level collection plate member thereof, and further configured with said substantially horizontal top opening corresponding to about ⅓ of said first-level collection plate surface, preferably from about 90° to 120° thereof, to receive said continuous upward flow of said hydrocarbons for delivery thereof at said well surface;

said elongate continuous helix further comprising said first-level plate member having at least a hexagonally-configured backflow reduction assembly comprising at least two series of rollers disposed on each of two opposing sides thereof to facilitate rotational movement thereof, for enabling said first-level member to accommodate said incoming stream of hydrocarbons and to restrict backflow thereof;

said second-level dislodging member comprising a second plurality of blade-like and rib-like members for dislodging and scooping said viscous hydrocarbons from said subsurface formation and for urging said dislodged hydrocarbon into said trough-like channel disposed at said well-bottom or a predetermined hydraulic fracturing well-level to dislodge said hydrocarbons from said downhole formation and to urge said dislodged hydrocarbons upwardly into said continuous trough-like channel; and said multi-tasking rod guide adapted to synchronously rotate with said hydrocarbon as said hydrocarbons flow upwardly through said continuous trough-like channel within said production string of said well, while simultaneously centralizing said pump rod.

16. The multi-tasking rod guide apparatus recited in claim 15, wherein said first plurality of successive plate bottom-level members of said continuous helix is configured with each said plate member preferably offset 110° to 120° relative to the horizontal.

17. The multi-tasking rod guide apparatus recited in claim 16, wherein said hydrocarbons flow upwardly through said continuous trough-like channel is achieved by pressurized movement of said hydrocarbons from said second-level dislodging member successively to one said plate member of said first plurality of successive plate members to the next upper said plate member of said first plurality of successive plate members, until said first-level collection plate member is reached for delivery of said upwardly flowing hydrocarbon to said well surface.

18. The multi-tasking rod guide apparatus recited in claim 17, wherein said first-level collection plate member is configured with a top-opening to enable uninhibited pressurized collection of said hydrocarbons driven upwardly through said trough-like channel member via said pressurized squirting and spraying action onto said first-level collection plate for ultimate deposit thereof at the well surface.

19. The multi-tasking rod guide apparatus recited in claim 18, wherein said backflow reduction assembly comprises a first circular stationary plate member having an arc of about 240° and a corresponding mated second circular slidable lid plate member having of about 120°.

20. The multi-tasking rod guide apparatus recited in claim 19, wherein said hydrocarbons backflow is reduced when said first circular stationary plate member and said second circular slidable lid plate member are disposed in a mated relationship wherein there is no gap therebetween.

21. The multi-tasking rod guide apparatus recited in claim 20, wherein said hydrocarbons backflow is unrestricted when said first circular stationary plate member and said second circular slidable lid plate member are disposed in a separated relationship of about 90° to 120°, wherein a gap is manifest therebetween.

22. The multi-tasking rod guide apparatus recited in claim 21, wherein each said plate member of said first plurality of collection plate members further comprises a plurality of pillar members disposed vertically between each successive neighboring plate member to afford strength thereto as said pressurized upwardly-flowing hydrocarbons pass through said continuous trough-like channel and adjacent said plurality of collection plate members.

23. The multi-tasking rod guide apparatus recited in claim 22, wherein said helical member further comprises a bevel member located upon its rear surface, to avoid striking said production tubing in a flat disposition, thereby affording extra support thereto and promoting uninhibited continuous upward helical movement thereof.

* * * * *